US010111007B2

(12) United States Patent
Tagami et al.

(10) Patent No.: US 10,111,007 B2
(45) Date of Patent: Oct. 23, 2018

(54) SPEAKER DEVICE

(71) Applicant: SONY CORPORATION, Tokyo (JP)

(72) Inventors: Takahisa Tagami, Kanagawa (JP); Emiko Ikeda, Tokyo (JP); Naoya Kunikata, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/106,964

(22) PCT Filed: Jan. 15, 2015

(86) PCT No.: PCT/JP2015/050914
§ 371 (c)(1),
(2) Date: Jun. 21, 2016

(87) PCT Pub. No.: WO2015/115191
PCT Pub. Date: Aug. 6, 2015

(65) Prior Publication Data

US 2016/0345102 A1 Nov. 24, 2016

(30) Foreign Application Priority Data

Jan. 28, 2014 (JP) ..... 2014-013523

(51) Int. Cl.
*H04R 1/00* (2006.01)
*H04R 9/06* (2006.01)
(Continued)

(52) U.S. Cl.
CPC ..... *H04R 9/027* (2013.01); *H04R 7/12* (2013.01); *H04R 9/06* (2013.01)

(58) Field of Classification Search
CPC ..... H04R 9/027; H04R 7/12; H04R 9/06
(Continued)

(56) References Cited

U.S. PATENT DOCUMENTS

2004/0156527 A1* 8/2004 Stiles ..... H04R 9/063 381/412
2004/0218778 A1* 11/2004 Weisman ..... H04R 9/041 381/396

(Continued)

FOREIGN PATENT DOCUMENTS

EP 2563042 2/2013
JP 2008-118331 11/2006

(Continued)

OTHER PUBLICATIONS

Microfilm of the specification and drawings annexed to the request of Japanese Utility Model Application No. 143678/1892(Laid-open No. 48197/1984), Mar. 30, 1984, Matsushita Electric Industrial Co., Ltd.

(Continued)

*Primary Examiner* — Duc Nguyen
*Assistant Examiner* — Sean H Nguyen
(74) *Attorney, Agent, or Firm* — Sheridan Ross P.C.

(57) ABSTRACT

Acoustic conversion efficiency is improved and a stable signal reproduction operation is ensured. Provided is a speaker device including: a magnet; a yoke attached to the magnet and at least one sub-plate that is separated from the main plate in an axial direction of the central axis; a coil bobbin formed in a tubular shape and changeable in the axial direction; a voice coil wound around an outer circumferential surface of the coil bobbin, at least a portion of the voice coil being disposed in a main magnetic gap formed between the main plate and the yoke; a vibration plate having an inner circumferential portion connected to the coil bobbin; and a magnetic fluid filling at least one sub-magnetic gap formed between the sub-plate and the yoke, wherein a through-hole positioned in the sub-magnetic gap filled with the magnetic fluid is formed in the coil bobbin.

14 Claims, 35 Drawing Sheets

(51) Int. Cl.
*H04R 11/02* (2006.01)
*H04R 9/02* (2006.01)
*H04R 7/12* (2006.01)

(58) Field of Classification Search
USPC ..... 381/400
See application file for complete search history.

(56) References Cited

U.S. PATENT DOCUMENTS

| | | | | |
|---|---|---|---|---|
| 2008/0199039 | A1* | 8/2008 | Bohlender | H04R 9/06 381/412 |
| 2013/0051605 | A1* | 2/2013 | Tagami | H04R 9/027 381/414 |

FOREIGN PATENT DOCUMENTS

| | | | |
|---|---|---|---|
| JP | 2013-46112 | A | 3/2013 |
| WO | WO 96/13960 | | 5/1996 |
| WO | WO 03/010998 | A1 | 2/2003 |

OTHER PUBLICATIONS

Microfilm of the specification and drawings annexed to the request of Japanese Utility Model Application No. 137342/1982(Laid-open No. 42691/1984), Mar. 19, 1984, Pioneer Corp.
International Search Report prepared by the Japanese Patent Office dated Feb. 5, 2015, for International Application No. PCT/JP2015/050914.
Extended European Search Report for European Patent Application No. 15743795.5 dated Oct. 20, 2017, 7 pages.

* cited by examiner

A

B

A

B

C

D

A

B

C

A

B

A

B

A

B

A

B

C

A

B

A

B

SPEAKER DEVICE

CROSS REFERENCE TO RELATED APPLICATIONS

This application is a national stage application under 35 U.S.C. 371 and claims the benefit of PCT Application No. PCT/JP2015/050914 having an international filing date of 15 Jan. 2015, which designed the United States, which PCT application claimed the benefit of Japanese Priority Patent Application No. 2014-013523 filed 28 Jan. 2014, the disclosures of which are incorporated herein by reference in their entirety.

TECHNICAL FIELD

The present technology relates to a technical field that regards to a speaker device in which a magnetic gap is filled with a magnetic fluid.

CITATION LIST

Patent Document

Patent Document 1: Japanese Patent Application Laid-Open No. 2013-046112

Patent Document 2: Japanese Patent Application Laid-Open No. 2008-118331

BACKGROUND ART

For example, there is a speaker device in which a yoke having an annular magnet and a center pole portion and a plate made of a magnetic material are included, and a voice coil wound around a coil bobbin is held by a magnetic gap formed between the center pole portion and the plate. In this type of speaker device, when the voice coil is energized, the coil bobbin changes (moves) in an axial direction of the center pole portion, and audio is output.

In addition, there is a speaker device, which is similar to the above-described speaker device, provided with an annular and elastic damper. Here, an inner circumferential portion of the damper is connected to an outer circumferential surface of a coil bobbin, and an outer circumferential portion of the damper is connected to a frame that functions as a casing. The damper has a function of holding a voice coil in a magnetic gap without touching a plate when the coil bobbin is changed.

Incidentally, the damper accounts for a certain weight ratio of the whole speaker device. Thus, the presence of the damper increases a weight of the speaker device and causes suppression of change of the coil bobbin and decrease in acoustic conversion efficiency. For example, the weight ratio of the damper to the whole speaker device is set to about 15% to 20%.

In this regard, there is a speaker device in which a predetermined portion is filled with a magnetic fluid instead of a damper, and a weight of the speaker device is reduced by omitting the damper, thereby improving acoustic conversion efficiency (for example, see Patent Document 1 and Patent Document 2).

A speaker device disclosed in Patent Document 1 has a configuration in which a magnetic gap at a position where a voice coil is present is filled with a magnetic fluid.

A speaker device disclosed in Patent Document 2 has a configuration in which a sub-magnetic circuit is included in addition to a main magnetic circuit, a sub-magnetic gap is formed in the sub-magnetic circuit, and the sub-magnetic gap is filled with a magnetic fluid to support a voice coil.

SUMMARY OF THE INVENTION

Problems to be Solved by the Invention

However, referring to the speaker device disclosed in Patent Document 1, since the voice coil is present in the magnetic gap filled with the magnetic there is a concern that, when an amplitude is large, the magnetic fluid may be easily scattered by agitation of the magnetic fluid due to unevenness of a cross-sectional shape of the voice coil, and the amount of the filled magnetic fluid may be reduced, and thus stable signal reproduction may be hindered.

In addition, referring to the speaker device disclosed in Patent Document 2, even though the sub-magnetic gap, in which no voice coil is present, is filled with the magnetic fluid, and thus the magnetic fluid is rarely scattered, the magnetic fluid filling the sub-magnetic gap is separated into an internal part and an external part by a coil bobbin. Therefore, there is a concern that fluidity of the magnetic fluid may be hindered, and thus accuracy of centering of the coil bobbin may decrease. Further, there is a concern that distortion of an input may be insufficiently reduced, and a stable signal reproduction operation may not be ensured.

Therefore, an object of the technology is to overcome the above-mentioned problems to improve acoustic conversion efficiency and ensure a stable signal reproduction operation.

Solutions to Problems

In the first place, a speaker device according to the present technology includes: a magnet having a central axis; a yoke having a central axis, the central axis of the yoke being identical to the central axis of the magnet, the magnet being attached to the yoke; a main plate attached to the magnet; at least one sub-plate attached to the magnet and positioned to be separated from the main plate in an axial direction of the central axis; a coil bobbin formed in a tubular shape and changeable in the axial direction; a voice coil wound around an outer circumferential surface of the coil bobbin, at least a portion of the voice coil being disposed in a main magnetic gap formed between the main plate and the yoke; a vibration plate having an inner circumferential portion connected to the coil bobbin, and vibrating according to a change of the coil bobbin; and a magnetic fluid filling at least one sub-magnetic gap formed between the sub-plate and the yoke, and a through-hole positioned in the sub-magnetic gap filled with the magnetic fluid is formed in the coil bobbin.

In this way, the magnetic fluid flows between the sub-plate and the yoke through the through-hole.

In the second place, in the speaker device according to the present technology, it is desirable that a magnetic gradient is formed to change a magnetic force with respect to the magnetic fluid by changing a magnetic flux density in the axial direction.

In this way, the magnetic fluid to be scattered from the sub-magnetic gap is pulled to a side at which a magnetic force is strong in the axial direction.

In the third place, in the speaker device according to the present technology, it is desirable that a magnetic gradient is formed to change a magnetic force with respect to the magnetic fluid by changing a magnetic flux density in a circumferential direction of the central axis.

In this way, the magnetic fluid to be scattered from the sub-magnetic gap is pulled to a side at which a magnetic force is strong in the circumferential direction.

In the fourth place, in the speaker device according to the present technology, it is desirable that the through-hole is formed at a position allowing a flow of the magnetic fluid between the sub-plate and the yoke in a variation range of the coil bobbin in the axial direction.

In this way, the magnetic fluid flows between the sub-plate and the yoke through the through-hole irrespective of a changed location of the coil bobbin in the axial direction.

In the fifth place, in the speaker device according to the present technology, it is desirable that a plurality of through-holes is formed to be separated from one another in a circumferential direction of the coil bobbin, and positions of the plurality of through-holes are shifted in the axial direction.

In this way, the magnetic fluid flows between the sub-plate and the yoke through any one of the through-holes when the coil bobbin is changed in the axial direction.

In the sixth place, in the speaker device according to the present technology, it is desirable that the through-hole has a slit shape extending in the axial direction of the coil bobbin, and a plurality of through-holes is formed to be separated from one another in a circumferential direction of the coil bobbin, and positions of the plurality of through-holes are shifted in the axial direction.

In this way, the magnetic fluid flows between the sub-plate and the yoke through any one of the through-holes when the coil bobbin is changed in the axial direction.

In the seventh place, in the speaker device according to the present technology, it is desirable that the main magnetic gap is positioned on a side of the vibration plate from the sub-magnetic gap.

In this way, the voice coil is positioned on a side of the vibration plate.

In the eighth place, in the speaker device according to the present technology, it is desirable that the sub-magnetic gap is positioned on a side of the vibration plate from the main magnetic gap, a support ring is attached to an inner circumferential portion of the sub-plate, and at least a portion of the support ring is positioned inside the inner circumferential surface of the sub-plate.

In this way, an interval of the sub-magnetic gap formed between the sub-plate and the yoke becomes small.

In the ninth place, in the speaker device according to the present technology, it is desirable that the support ring corresponds to a magnetic substance.

In this way, a magnetic flux density of the sub-magnetic gap formed between the sub-plate and the center pole portion becomes high.

In the tenth place, in the speaker device according to the present technology, it is desirable that a saturated magnetic flux of the magnetic fluid is set to 30 ml to 40 mT, and a viscosity of the magnetic fluid is set to 300 cp or less.

In this way, the magnetic fluid is rarely scattered, and change of the coil bobbin is rarely suppressed by the magnetic fluid.

In the eleventh place, in the speaker device according to the present technology, it is desirable that a magnetic flux change unit forming the magnetic gradient in the axial direction is provided in the sub-plate or the yoke.

In this way, the magnetic gradient is easily formed in the axial direction of the yoke.

In the twelfth place, in the speaker device according to the present technology, it is desirable that a distal end portion of the yoke is caused to protrude from the sub-plate in the axial direction, and the distal end portion is provided as the magnetic flux change unit.

In this way, a configuration of the magnetic flux change unit is simplified.

In the thirteenth place, in the speaker device according to the present technology, it is desirable that an inclined plane inclined in the axial direction is formed on a surface of the sub-plate or the yoke, and a portion on which the inclined plane is formed is provided as the magnetic flux change unit.

In this way, processing of the magnetic flux change unit is simplified.

In the fourteenth place, in the speaker device according to the present technology, it is desirable that a curved surface is formed on a surface of the sub-plate or the yoke, and a portion on which the curved surface is formed is provided as the magnetic flux change unit.

In this way, a degree of freedom becomes high with respect to change of a magnetic flux density.

In the fifteenth place, in the speaker device according to the present technology, it is desirable that a magnetic flux change unit forming the magnetic gradient in the axial direction is provided in the sub-plate and the yoke.

In this way, the magnetic gradient is easily formed in the axial direction of the yoke, and a degree of freedom becomes high with respect to change of a magnetic flux density.

In the sixteenth place, in the speaker device according to the present technology, it is desirable that an inclined plane inclined in the axial direction is formed on respective surfaces of the sub-plate and the yoke, and respective portions on which the inclined plane is formed are provided as the magnetic flux change unit.

In this way, processing of the magnetic flux change unit is simplified, and a degree of freedom becomes high with respect to change of a magnetic flux density.

In the seventeenth place, in the speaker device according to the present technology, it is desirable that a curved surface is formed on a surface of the sub-plate or the yoke, and a portion on which the curved surface is formed is provided as the magnetic flux change unit.

In this way, a degree of freedom becomes high with respect to change of a magnetic flux density.

In the eighteenth place, in the speaker device according to the present technology, it is desirable that a plurality of lead wires connected to the voice coil is provided, and the plurality of lead wires is symmetrically disposed about a central axis of the coil bobbin.

In this way, occurrence of a rolling phenomenon of the coil bobbin is suppressed.

In the nineteenth place, in the speaker device according to the present technology, it is desirable that a plurality of lead wires connected to the voice coil, and at least one connecting wire connected to the coil bobbin are provided, and the plurality of lead wires and the connecting wire are symmetrically disposed about the central axis.

In this way, occurrence of a rolling phenomenon of the coil bobbin is suppressed.

Effects of the Invention

According to the technology, a magnetic fluid flows between a sub-plate and a yoke through a through-hole, and thus it is possible to improve acoustic conversion efficiency and ensure a stable signal reproduction operation.

It should be noted that the effects described, herein are not restricted, and any effect described in this disclosure may correspond to the effects.

MODE FOR CARRYING OUT THE INVENTION

Hereinafter, content of the technology will be described according to accompanying drawings.

[Detailed Configuration of Speaker Device]

A description will be given of a detailed configuration of a speaker device 1 according to a first embodiment using FIG. 1. In description herein, upward, downward, forward, backward, leftward, and rightward directions are indicated by setting a direction in which the speaker device 1 is headed as the forward direction.

The upward, downward, forward, backward, leftward, and rightward directions described below are described for convenience of description, and the technology is not applied by being restricted to these directions.

Figure 1:
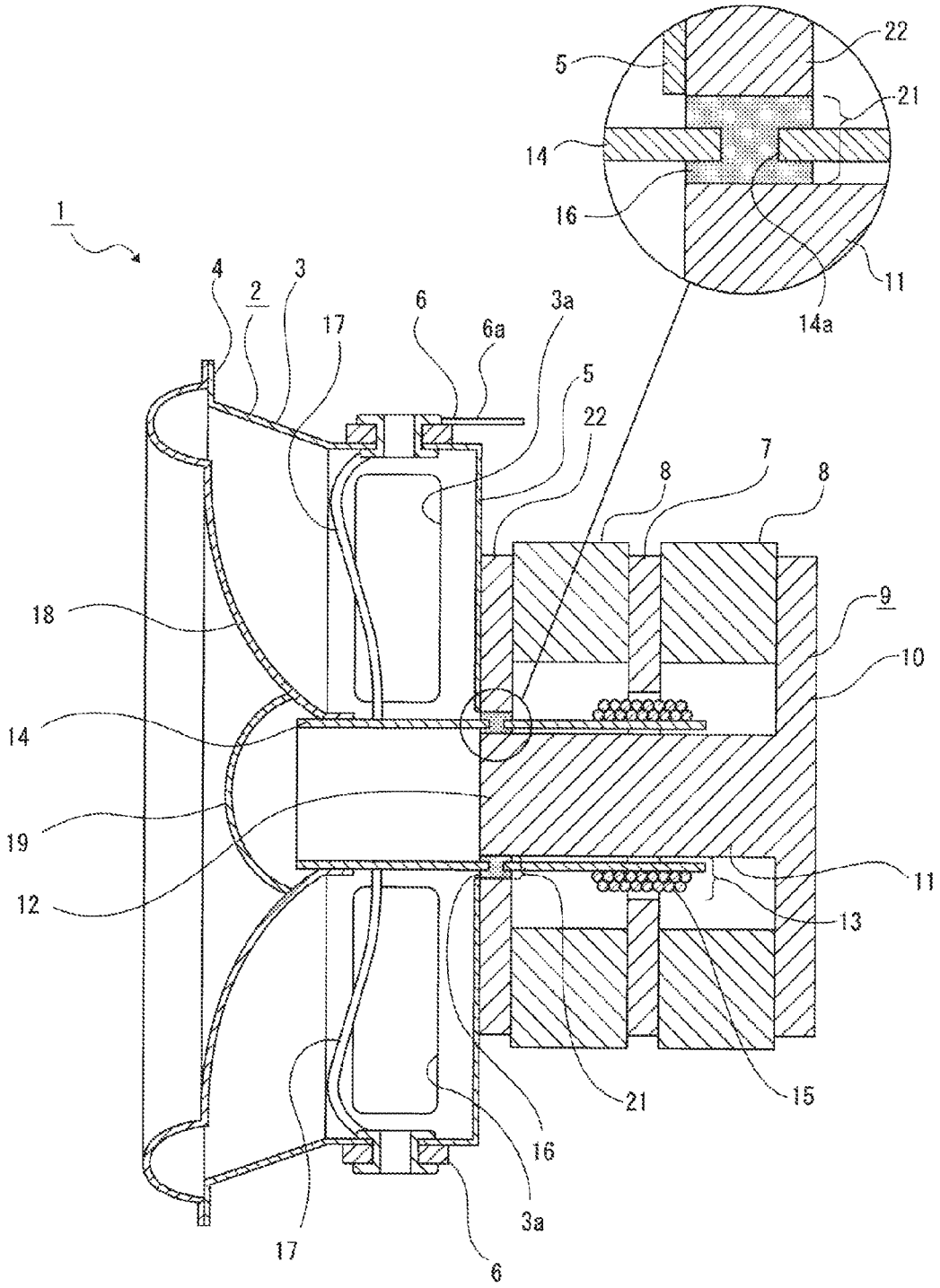
FIG. 1 is a diagram illustrating an embodiment of a speaker device of the technology along with FIGS. 2 to 36, and this figure is an enlarged cross-sectional view of a speaker device of a first embodiment.

FIG. 1 is an enlarged cross-sectional view of the speaker device 1 according to the first embodiment. As illustrated in FIG. 1, the speaker device 1 has a frame 2 that functions as a casing. For example, the speaker device 1 is a woofer that outputs a lower register.

The frame 2 has a tubular-shaped portion 3 formed in a substantially cylindrical shape, an attaching portion 4 that projects outward from a front edge of the tubular-shaped portion 3, and a connecting portion 5 that projects inward from a rear edge of the tubular-shaped portion 3.

A plurality of communication holes 3*a*, 3*a*, . . . separated from one another at equal intervals in a circumferential direction is formed in the tubular-shaped portion 3. Terminals 6 and 6 are attached to the tubular-shaped portion 3 at positions opposite to each other at 180° in the circumferential direction. The terminal 6 is provided as a junction for connection to an amplifier (not illustrated), and has a terminal portion 6*a*.

A sub-plate 22 made of a magnetic material is attached to a rear surface of the connecting portion 5 of the frame 2. The sub-plate 22 is formed in a substantially toric shape having a thin thickness.

Magnets 8 and 8 formed in toric shapes and separated from each other in a front-rear direction are disposed in a rear of the sub-plate 22. A front magnet 8 is attached to a rear surface of the sub-plate 22, and a main plate 7 made of a magnetic material is attached to between the magnets 8 and 8. The main plate 7 is formed in a substantially toric shape having a thin thickness.

A yoke 9 is attached to a rear surface of a rear magnet 8. The yoke 9 is formed by integrally forming a disc-shaped base surface portion 10 and a center pole portion 11 protruding forward from a center portion of the base surface portion 10. In addition, for example, the center pole portion 11 is formed in a columnar shape. Referring to the yoke 9, a front surface of the base surface portion 10 is attached to the rear surface of the rear magnet 8.

The main plate 7, the sub-plate 22, the magnets 8 and 8, and the yoke 9 are combined with one another while central axes thereof are identical to one another. Referring to the yoke 9, for example, a front surface of the center pole portion 11 is disposed on the same surface as a front surface of the sub-plate 22, and a space between the sub-plate 22 and the center pole portion 11 is formed as a sub-magnetic gap 21. A space between the main plate 7 and the center pole portion 11 is formed as a main magnetic gap 13.

A coil bobbin 14 is disposed on an outer circumferential side of the center pole portion 11 of the yoke 9 in a state in which the coil bobbin 14 is changeable (movable) in the front-rear direction, that is, an axial direction of the center pole portion 11. The coil bobbin 14 is formed in a cylindrical shape, and a voice coil 15 is wound around an outer circumferential surface in a rear end portion of the coil bobbin 14.

For example, through-holes 14*a*, 14*a*, . . . separated from one another at equal intervals in a circumferential direction are formed in the coil bobbin 14.

A portion of the voice coil 15 is positioned in the main magnetic gap 13. A portion of the coil bobbin 14 is positioned in the sub-magnetic gap 21, and another portion of the coil bobbin 14 is positioned in the main magnetic gap 13.

In the speaker device 1, a first magnetic circuit is configured by the main plate 7, the rear magnet 8, the base surface portion 10 of the yoke 9, and the center pole portion 11 of the yoke 9, and a second magnetic circuit is configured by the main plate 7, the front magnet 8, the sub-plate 22, and the center pole portion 11 of the yoke 9.

The sub-magnetic gap 21 is filled with a magnetic fluid 16. The coil bobbin 14 is changeable (movable) in the axial direction by an action of the magnetic fluid 16.

The magnetic fluid 16 is formed by dispersing particles of a magnetic substance in water or oil using a surfactant. For example, a saturated magnetic flux thereof is set to 30 millitesla (mT) to 40 mT, and a viscosity thereof is set to less than or equal to 300 centipoise (cP) (=3 Pascal·second (Pa·s)).

Both end portions of the voice coil 15 are connected to the terminals 6 and 6 by lead wires 17 and 17. The lead wires 17 and 17 are attached to the coil bobbin 14 while being symmetrically disposed about a central axis P of the coil bobbin 14 (see FIG. 2). For example, the lead wires 17 and 17 are disposed in linear shapes.

An arbitrary number of lead wires 17 may be provided when a plurality of lead wires 17 is provided, and three or more lead wires 17 may be provided.

An annular vibration plate 18 is disposed on a front end side of the frame 2. Referring to the vibration plate 18, an outer circumferential edge is attached to the attaching portion 4 of the frame 2, and an inner circumferential edge is attached to a front end portion of the coil bobbin 14 (see FIG. 1). Therefore, the vibration plate 18 is vibrated using an outer circumferential portion as a fulcrum according to change of the coil bobbin 14 in the axial direction.

A center cap 19 is attached to an inner circumferential portion of the vibration plate 18, and the coil bobbin 14 is blocked from a front side by the center cap 19.

[Magnetic Circuits and Magnetic Flux Distribution]

Figure 3:
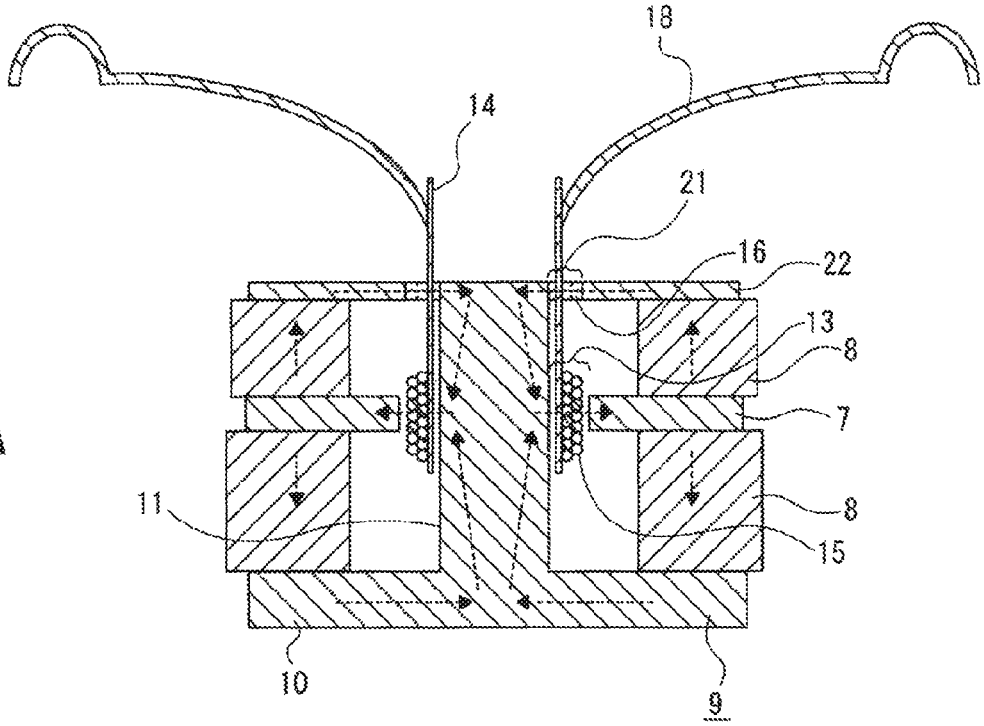
FIGS. 3A and 3B are conceptual diagrams illustrating a magnetic circuit of the speaker device and a magnetic flux distribution.
Figure 3:
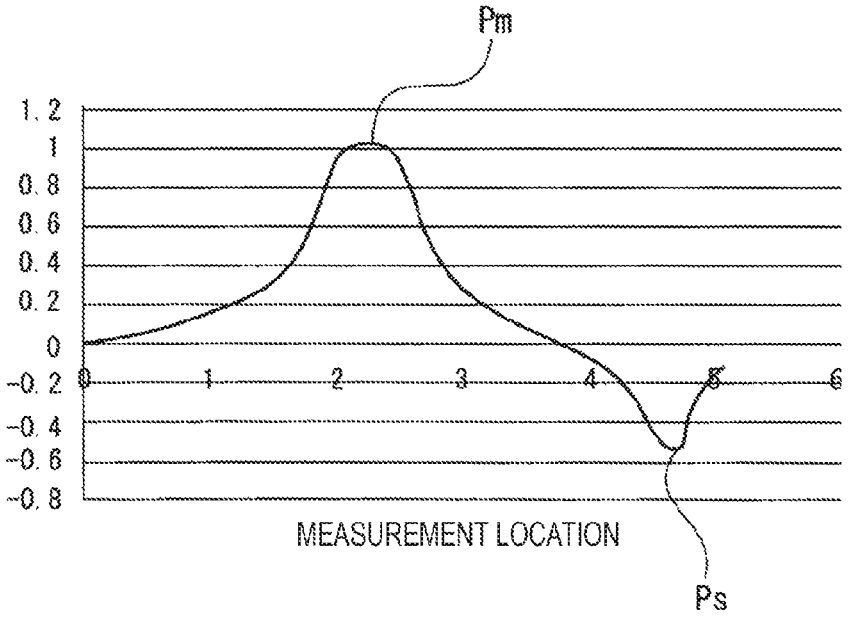

Hereinafter, the magnetic circuits and a magnetic flux distribution of the speaker device 1 will be described with reference to FIGS. 3A and 3B. FIG. 3A is a conceptual diagram illustrating the magnetic circuits of the speaker device 1, and FIG. 3B is a conceptual diagram illustrating the magnetic flux distribution of the speaker device 1.

As illustrated in FIG. 3A, the first magnetic circuit is configured by a path of the main plate 7, the rear magnet 8, the base surface portion 10 of the yoke 9, the center pole portion 11 of the yoke 9, and the main magnetic gap 13.

In addition, the second magnetic circuit is configured by a path of the main plate 7, the front magnet 8, the sub-plate 22, the sub-magnetic gap 21, the center pole portion 11 of the yoke 9, and the main magnetic gap 13.

A magnetic flux density of the main magnetic gap 13 is increased by configuring two magnetic circuits when compared to a case in which one magnetic circuit is configured. In the present embodiment, two magnetic circuits are suitable. However, the number of magnetic circuits is not restricted to two, and another number of magnetic circuits may be provided.

Further, magnetic flux density distributions of the main magnetic gap 13 and the sub-magnetic gap 21 in each magnetic circuit are illustrated in FIG. 3B. Measurement locations shown in FIG. 3B indicate respective locations in the axial direction (front-rear direction) of the center pole portion 11 including the main magnetic gap 13 and the sub-magnetic gap 21.

A value Pm of the magnetic flux density corresponds to a peak value in the main magnetic gap 13. A value Ps of the magnetic flux density corresponds to a peak value in the sub-magnetic gap 21. The value Ps of the sub-magnetic gap 21 has an opposite polarity to that of the value Pm of the magnetic flux density of the main magnetic gap 13, and an absolute value of the value Pm of the magnetic flux density is larger than an absolute value of the value Ps of the magnetic flux density.

[Action of Magnetic Fluid]

Figure 4:
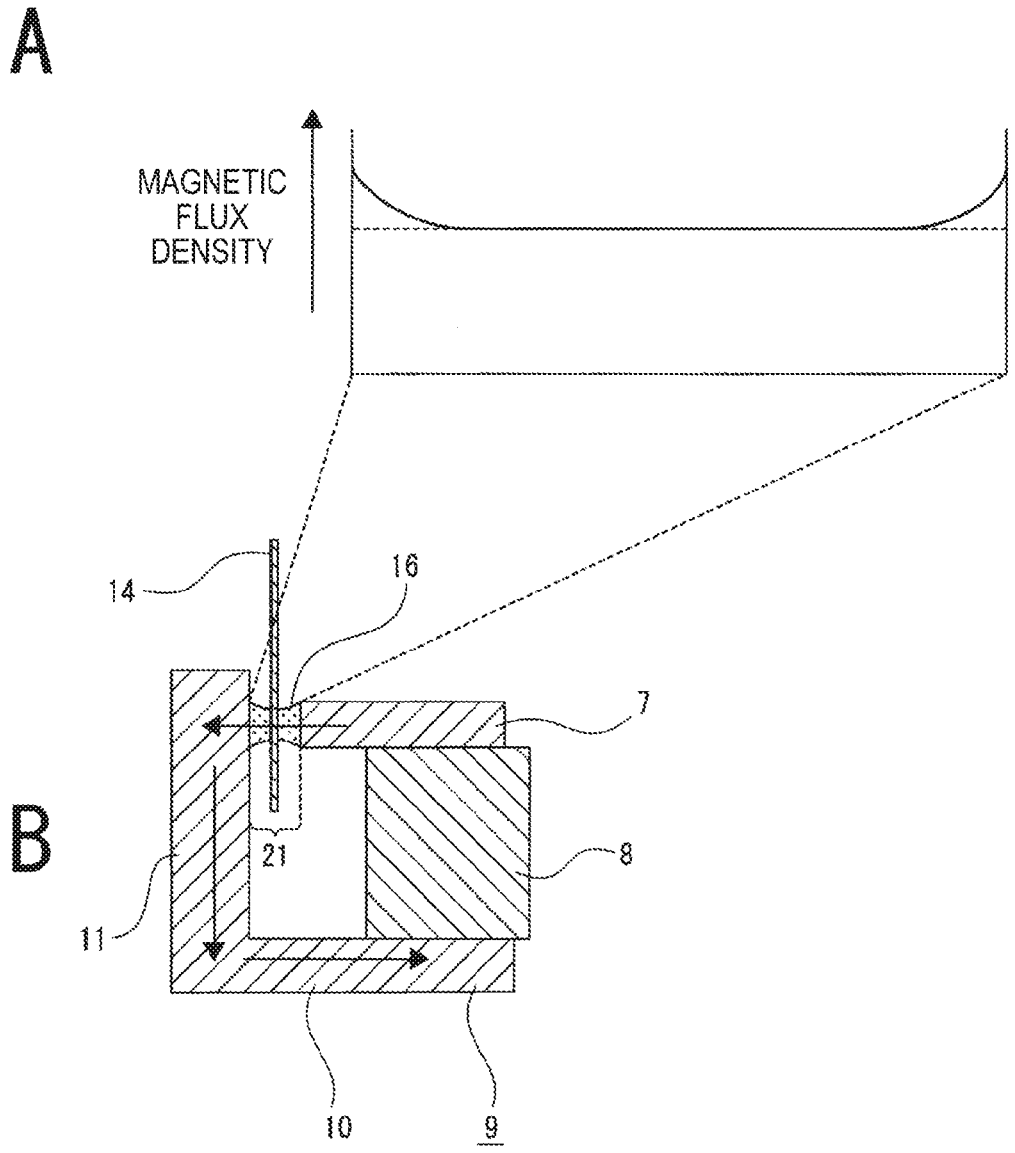
FIGS. 4A and 4B are diagrams illustrating a magnetic circuit including a magnetic gap and a magnetic flux density distribution.

Hereinafter, an action of the magnetic fluid will be described with reference to FIGS. 4A and 4B. FIG. 4B is a conceptual diagram of a magnetic circuit including a magnetic gap, and FIG. 4A is a diagram illustrating a magnetic flux density distribution of a magnetic gap portion. As illustrated in FIG. 4B, a case is considered in which the magnetic circuit is formed by a path of the plate 7, the magnetic gap 21, the center pole portion 11 of the yoke 9, the base surface portion 10 of the yoke 9, and the magnet 8.

The magnetic gap 21 is filled with the magnetic fluid 16, and the portion of the coil bobbin 14 is positioned in the magnetic gap 21.

As illustrated in FIG. 4A, referring to a magnetic flux distribution in the magnetic gap 21, a magnetic flux density is high near the plate 7 and near the center pole portion 11 on both end sides, and the magnetic flux density is constant in other portions. The magnetic fluid 16 is attracted to both sides at which the magnetic flux density is high. Thus, when a simultaneously pulling force from the magnetic fluid 16 to the both sides is applied to the coil bobbin 14, the nonmagnetic coil bobbin 14 is centered on a center portion of the plate 7 and the center pole portion 11. At the same time, the coil bobbin 14 may linearly vibrate in the axial direction (vertical direction in the figure).

[Shape of Wire of Voice Coil and Magnetic Fluid]

Hereinafter, a description will be given of a relation between a shape of the voice coil 15 and the magnetic fluid 16 (see FIG. 5 to FIG. 7C).

Figure 5:
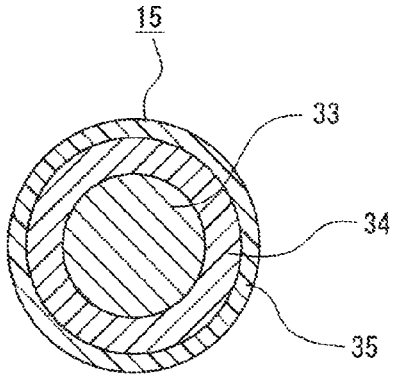
FIG. 5 is an enlarged cross-sectional view of a voice coil.
Figure 6:
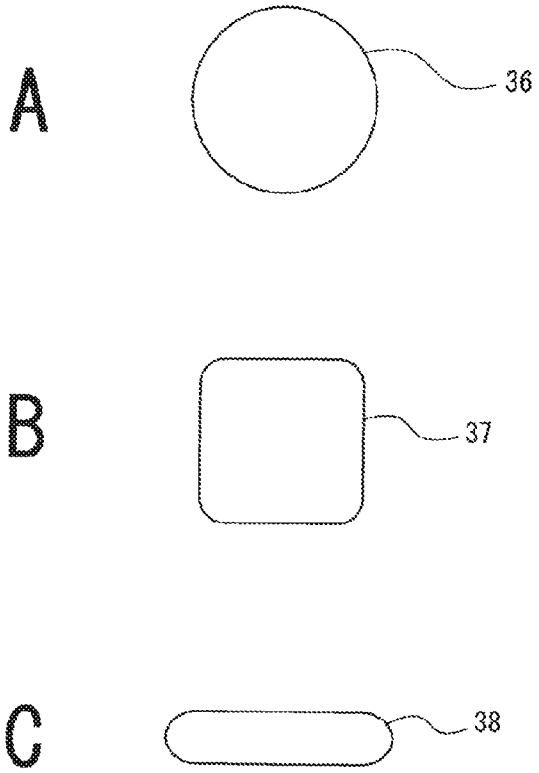
FIGS. 6A to 6C are conceptual diagrams illustrating a cross-sectional shape of a wire of the voice coil.
Figure 7:
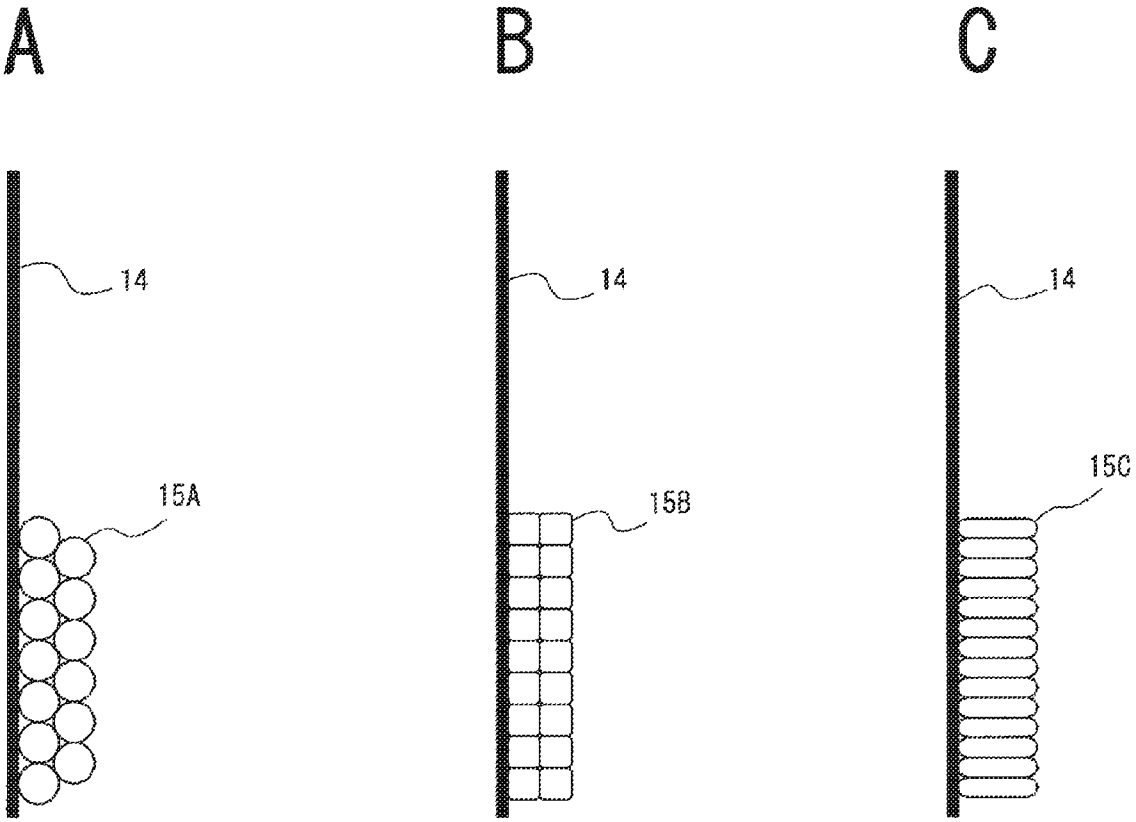
FIGS. 7A to 7C are diagrams illustrating a state in which the voice coil is wound around a coil bobbin.

As illustrated in FIG. 5, a wire of the voice coil 15 has a configuration in which an insulating film 34 and a fusion film 35 are provided on an outer circumference of a conducting wire 33. As illustrated in FIGS. 6A to 6C, a cross-sectional shape of the voice coil 15 is set to a round shape 36 (FIG. 6A), a rectangular shape 37 (FIG. 6B), a ribbon shape 38 (FIG. 6C), and the like, and a diameter of the voice coil 15 is set to about 0.05 mm to 0.5 mm.

FIGS. 7A to 7C illustrate a state in which the wire of the voice coil 15 is wound around the coil bobbin 14. FIG. 7A illustrates a voice coil 15A formed by winding a wire of the round shape 36 around the coil bobbin 14. FIG. 7B illustrates a voice coil 15B formed by winding a wire of the rectangular shape 37 around the coil bobbin 14. FIG. 7C illustrates a voice coil 15C formed by winding a wire of the ribbon shape 38 around the coil bobbin 14.

The wire of the voice coil 15 is wound around the coil bobbin 14 more than once, and thus unevenness is formed on a surface side thereof depending on diameters and shapes of the wire. When the voice coil 15 is present inside the magnetic fluid 16, there is concern that the magnetic fluid 16 may be scattered in an amplitude direction due to the unevenness when the voice coil 15 vibrates. For this reason, the amount of the filled magnetic fluid 16 may be reduced, and stable centering of the coil bobbin 14 may be disrupted. In addition, there is concern that abnormal noise may be generated when the magnetic fluid 16 is agitated due to motion of the voice coil 15, and signal generation sound may be distorted.

In this regard, in the speaker device 1, at least two magnetic gaps (the sub-magnetic gap 21 and the main magnetic gap 13) are formed, the voice coil 15, around which the coil bobbin 14 is wound, is positioned in the main magnetic gap 13 which is not filled with the magnetic fluid 16, and the sub-magnetic gap 21, in which a portion of the coil bobbin 14 is positioned, is filled with the magnetic fluid 16.

In this way, the sub-magnetic gap 21 is filled with the magnetic fluid 16, and the coil bobbin 14 is held at this position. In addition, the coil bobbin 14 corresponds to a thin foil-like material (aluminum, polyimide film, and the like), and a surface thereof is smoothly finished. Thus, there is no unevenness. For this reason, even when the coil bobbin 14 vibrates, there is no action for scattering the magnetic fluid 16, and the amount of the filled magnetic fluid 16 is rarely reduced.

Therefore, a decrease in the amount of the filled magnetic fluid 16 is suppressed, and thus a stable centering state of the coil bobbin 14 is ensured, generation of abnormal noise is prevented, acoustic conversion efficiency is improved, and excellent signal reproduction sound is acquired.

In addition, since the coil bobbin 14 is centered by the magnetic fluid 16, a damper for centering the voice coil 15 is unnecessary. Thus, improvement in acoustic conversion efficiency according to weight reduction of the speaker device 1 is attempted.

Further, as described in the foregoing, the through-holes 14*a*, 14*a*, . . . are formed in the coil bobbin 14. The through-holes 14*a*, 14*a*, . . . are positioned in the sub-magnetic gap 21 in which the magnetic fluid 16 is present.

Therefore, the magnetic fluid 16 flows between the sub-plate 22 and the center pole portion 11 of the yoke 9 through the through-holes 14*a*, 14*a*, . . . , and thus the magnetic fluid 16 filling the sub-magnetic gap 21 is not separated into an internal part and an external part by the coil bobbin 14. Therefore, excellent fluidity of the magnetic fluid 16 may be ensured, and thus accuracy of centering of the coil bobbin 14 may be improved, distortion of an input may be sufficiently reduced, and a stable signal reproduction operation may be ensured.

[Speaker Devices of Second Embodiment to Fifteenth Embodiment]

Hereinafter, a description will be given of speaker devices of a second embodiment to a fifteenth embodiment with reference to FIG. 8 to FIG. 21. Herein, the speaker devices of the second embodiment to the eighth embodiment correspond to an F-type magnetic circuit mode (F-type). The speaker devices of the ninth embodiment to the fifteenth embodiment correspond to a P-type magnetic circuit mode (P-type).

With regard to the speaker devices of the second embodiment to the fifteenth embodiment described below, a different portion from that of the first embodiment will be mainly described, and figures will be omitted.

[Second Embodiment]

Figure 8:
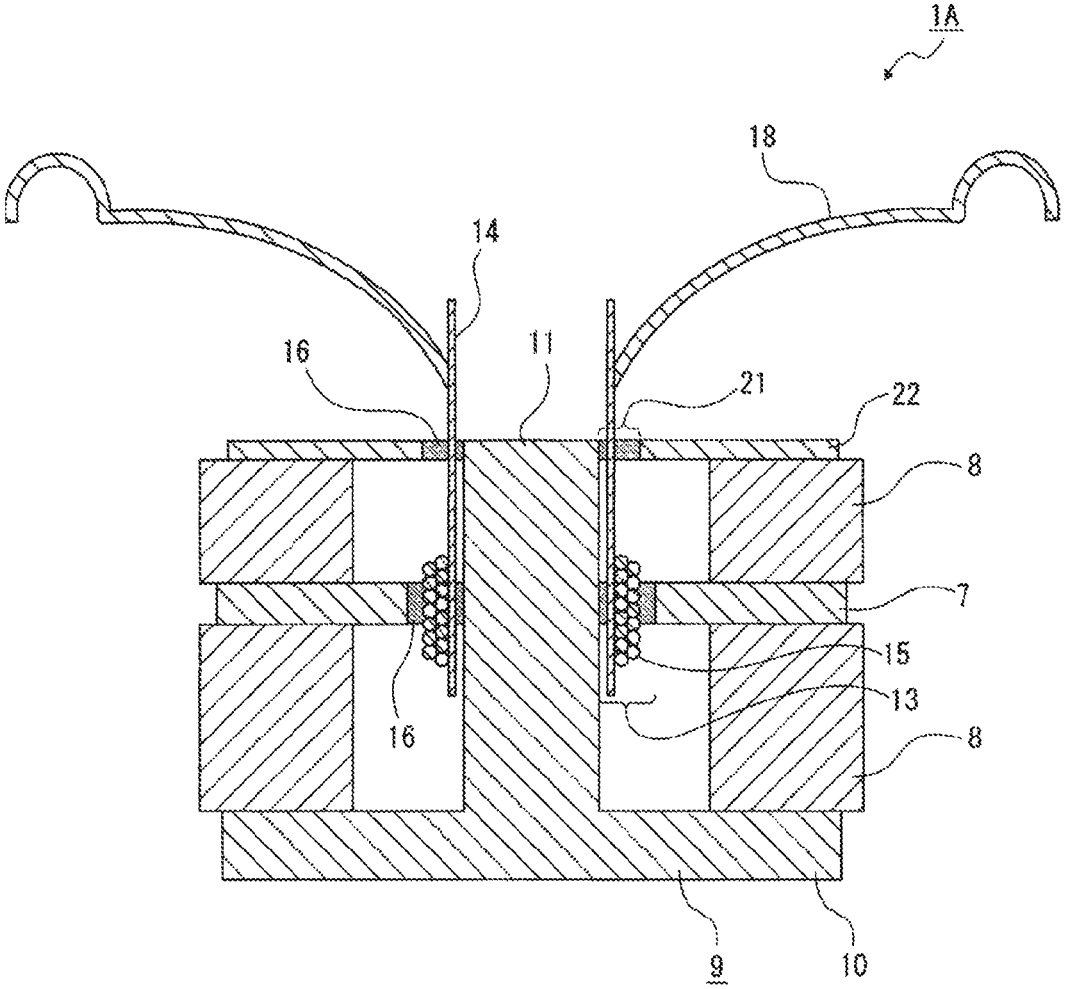
FIG. 8 is an enlarged cross-sectional view illustrating a configuration of a speaker device of a second embodiment.

A speaker device 1A of the second embodiment will be described with reference to FIG. 8.

Contrary to the speaker device 1 of the first embodiment, a main magnetic gap 13 is filled with a magnetic fluid 16 in the speaker device 1A of the second embodiment. In this way, stability of a vibration operation of a coil bobbin 14 increases when compared to an embodiment in which one magnetic gap is filled with the magnetic fluid 16.

[Third Embodiment]

Figure 9:
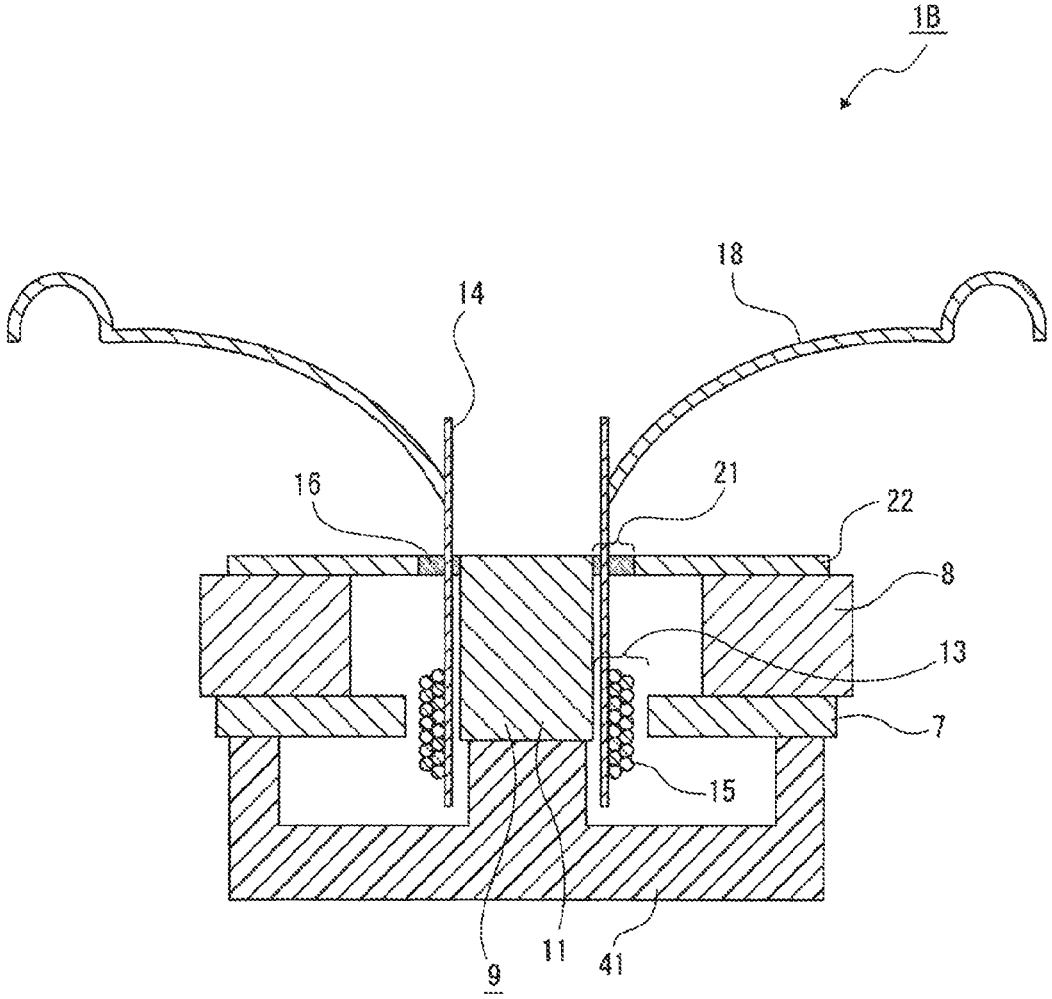
FIG. 9 is an enlarged cross-sectional view illustrating a configuration of a speaker device of a third embodiment.

A speaker device 1B of the third embodiment will be described with reference to FIG. 9.

Contrary to the speaker device 1 of the first embodiment, one magnetic circuit is provided in the speaker device 1B of the third embodiment. That is, a magnetic circuit is formed on a front side of a support frame 41 made of a nonmagnetic material. In the speaker device 1B, a yoke 9 is configured only by a center pole portion 11 (this description is applied to a speaker device 1C to a speaker device 1G described below).

The speaker device 1B is similar to the above description in that two magnetic gaps corresponding to a main magnetic gap 13 and a sub-magnetic gap 21 are included inside the magnetic circuit, and the sub-magnetic gap 21 is filled with a magnetic fluid 16. The speaker device 1B has only one magnet 8. Thus, the speaker device 1B has a simple structure, and may be miniaturized.

[Fourth Embodiment]

Figure 10:
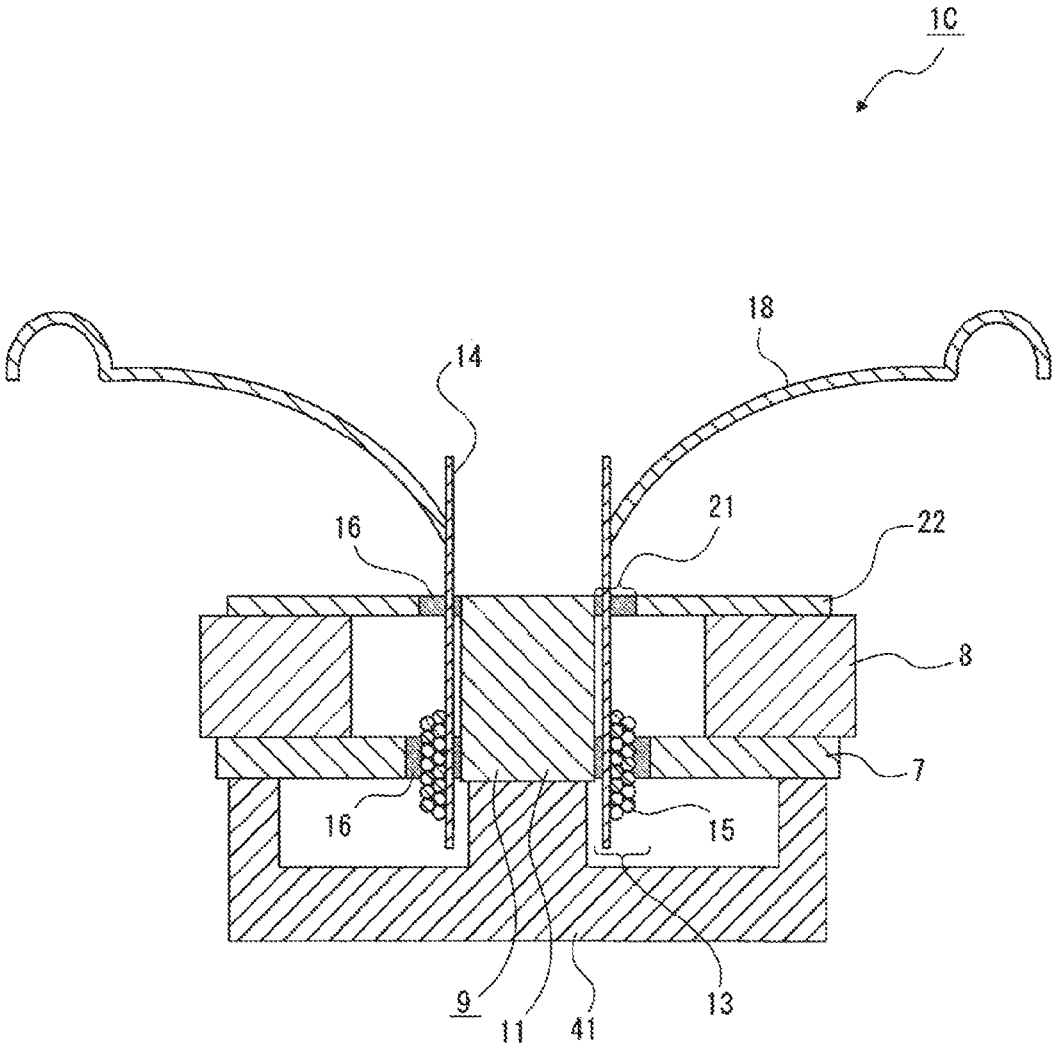
FIG. 10 is an enlarged cross-sectional view illustrating a configuration of a speaker device of a fourth embodiment.

The speaker device 1C of the fourth embodiment will be described with reference to FIG. 10.

Contrary to the speaker device 1B of the third embodiment, a main magnetic gap 13 is filled with a magnetic fluid 16 in the speaker device 1C of the fourth embodiment. In this way, stability of a vibration operation of a coil bobbin 14 increases when compared to an embodiment in which one magnetic gap is filled with the magnetic fluid 16.

[Fifth Embodiment]

Figure 11:
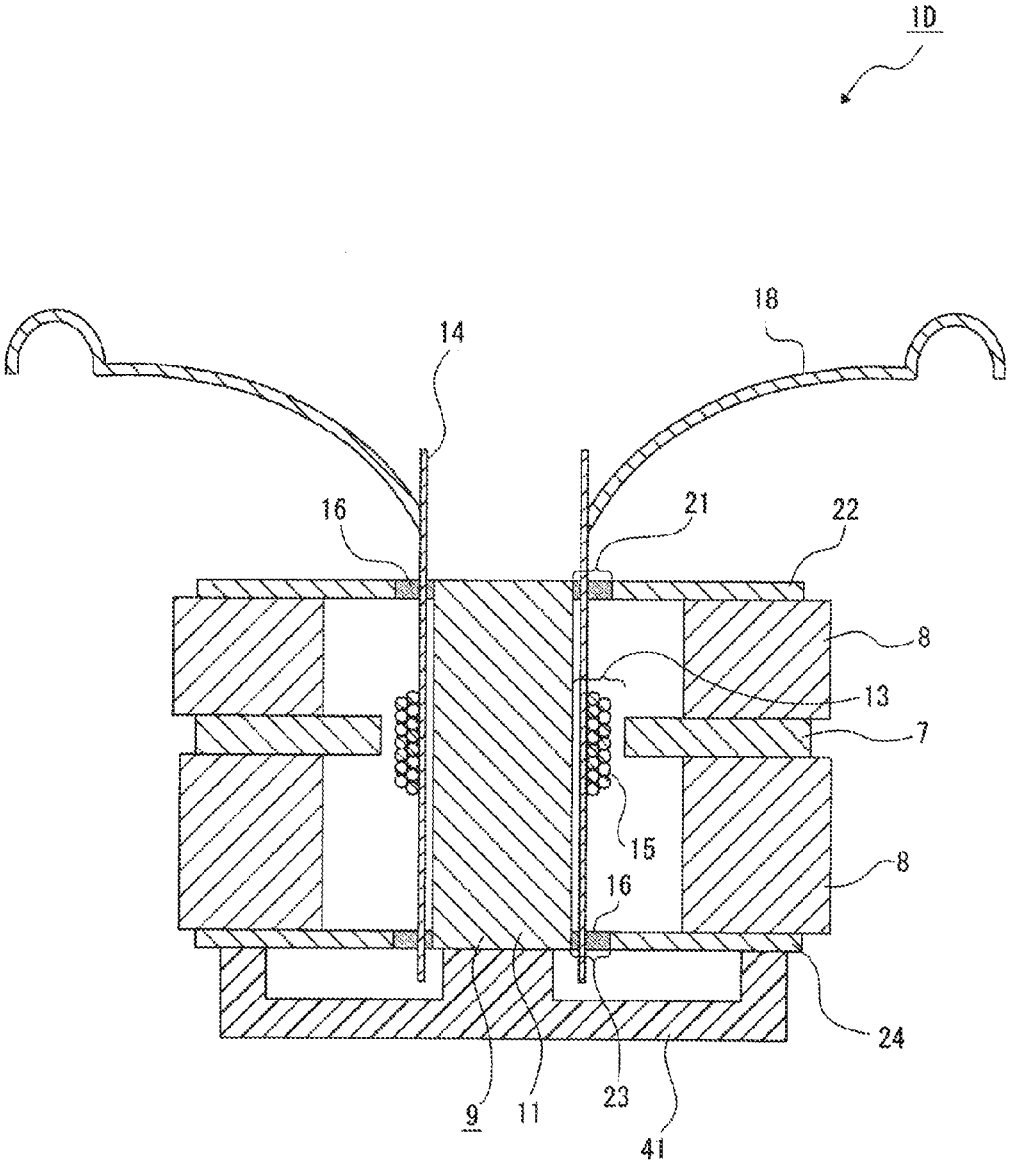
FIG. 11 is an enlarged cross-sectional view illustrating a configuration of a speaker device of a fifth embodiment.

The speaker device 1D of the fifth embodiment will be described with reference to FIG. 11.

Contrary to the speaker device 1 of the first embodiment, a sub-magnetic gap 23 is provided in addition to a sub-magnetic gap 21 in the speaker device 1D of the fifth embodiment. The sub-magnetic gap 23 is formed between a sub-plate 24 and a yoke 9.

In this way, the sub-magnetic gap 21 and the sub-magnetic gap 23 are formed on opposite sides of a voice coil 15, and a coil bobbin 14 is supported in the sub-magnetic gap 21 and the sub-magnetic gap 23. Thus, the coil bobbin 14 is more stably centered.

[Sixth Embodiment]

Figure 12:
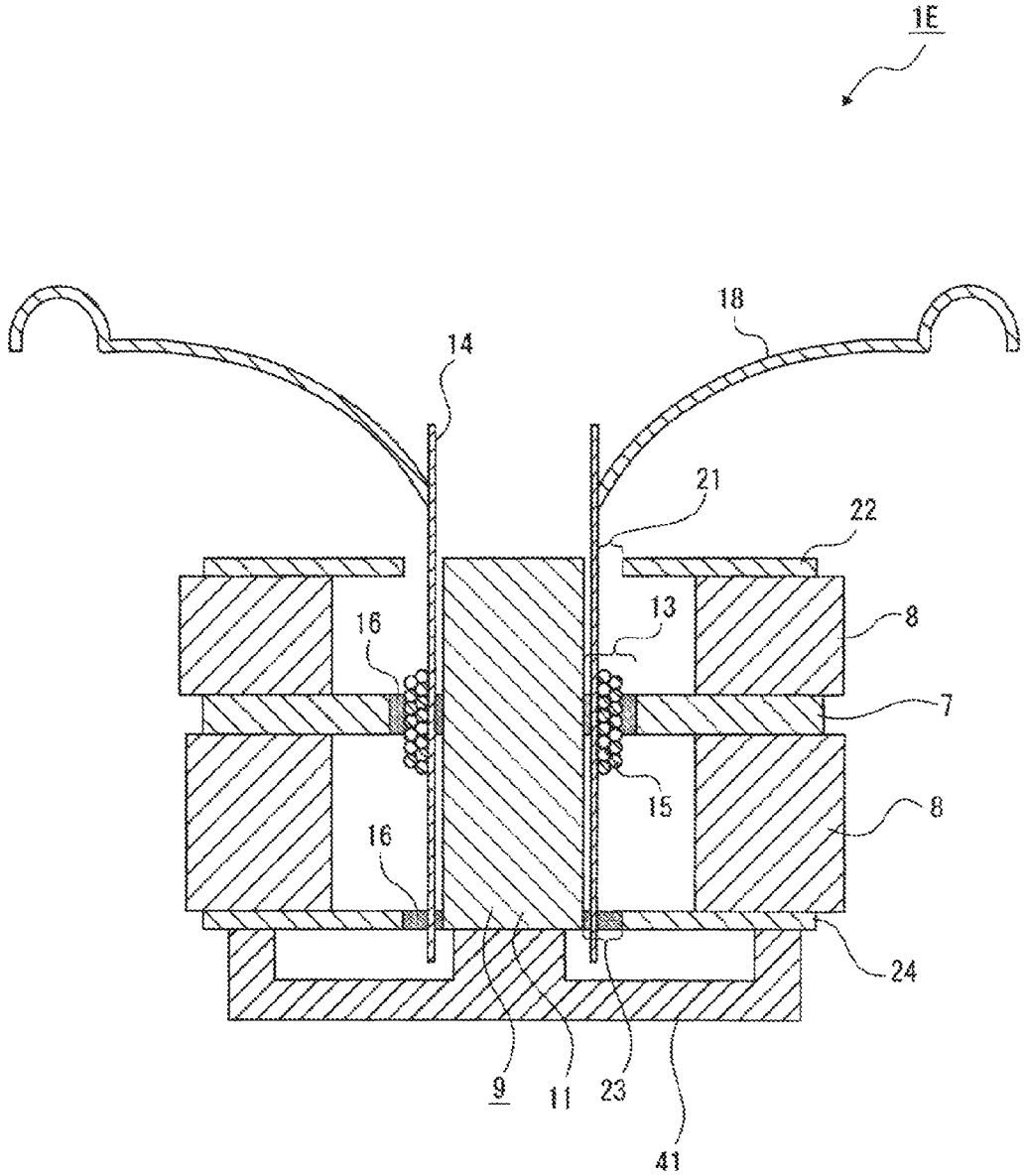
FIG. 12 is an enlarged cross-sectional view illustrating a configuration of a speaker device of a sixth embodiment.

The speaker device 1E of the sixth embodiment will be described with reference to FIG. 12.

Contrary to the speaker device 1D of the fifth embodiment, a sub-magnetic gap 21 is not filled with a magnetic fluid 16, and a main magnetic gap 13 is filled with the magnetic fluid 16 in the speaker device 1E of the sixth embodiment. In this way, stability of a vibration operation of a coil bobbin 14 increases when compared to an embodiment in which one magnetic gap is filled with the magnetic fluid 16.

[Seventh Embodiment]

Figure 13:
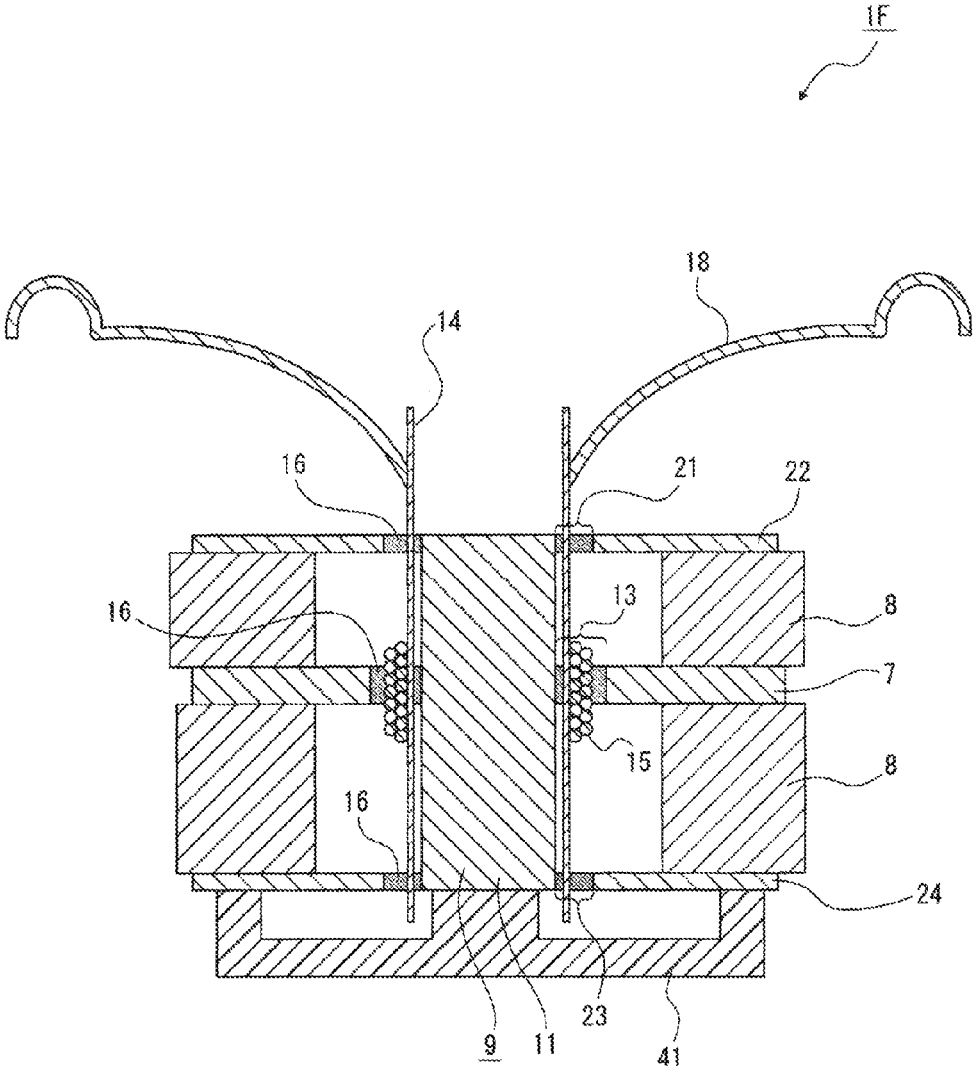
FIG. 13 is an enlarged cross-sectional view illustrating a configuration of a speaker device of a seventh embodiment.

The speaker device 1F of the seventh embodiment will be described with reference to FIG. 13.

Contrary to the speaker device 1D of the fifth embodiment, a main magnetic gap 13 is filled with a magnetic fluid 16 in the speaker device 1F of the seventh embodiment. In this way, stability of a vibration operation of a coil bobbin 14 further increases.

[Eighth Embodiment]

Figure 14:
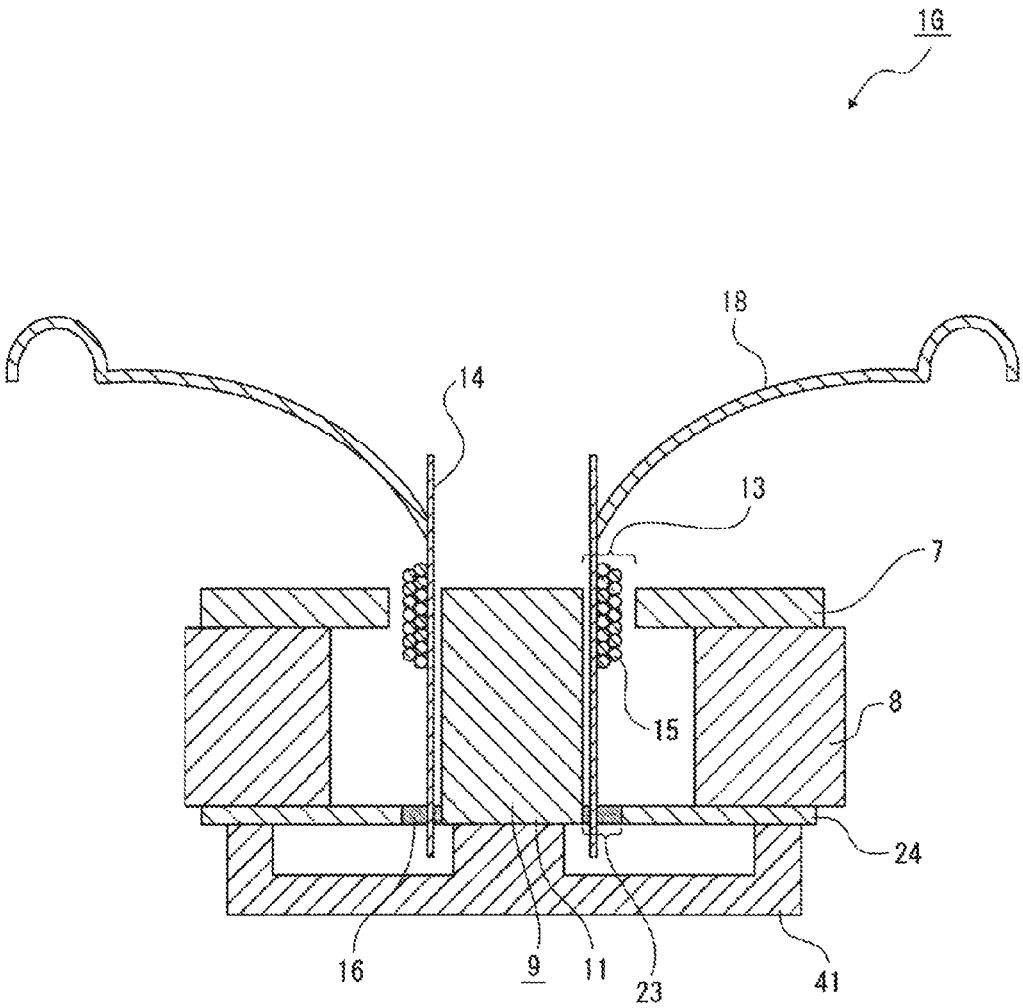
FIG. 14 is an enlarged cross-sectional view illustrating a configuration of a speaker device of an eighth embodiment.

The speaker device 1G of the eighth embodiment will be described with reference to FIG. 14.

Contrary to the speaker device 1B of the third embodiment, positions of a sub-magnetic gap 21 and a main magnetic gap 13 are switched in the speaker device 1G of the eighth embodiment. Then, a main plate 7 is attached to a front surface of a magnet 8, and a sub-plate 24 is attached to a rear surface of the magnet 8. A sub-magnetic gap 23 is filled with a magnetic fluid 16.

The speaker device 1G has only one magnet 8. Thus, the speaker device 1G has a simple structure, and may be miniaturized.

[Ninth Embodiment]

Figure 15:
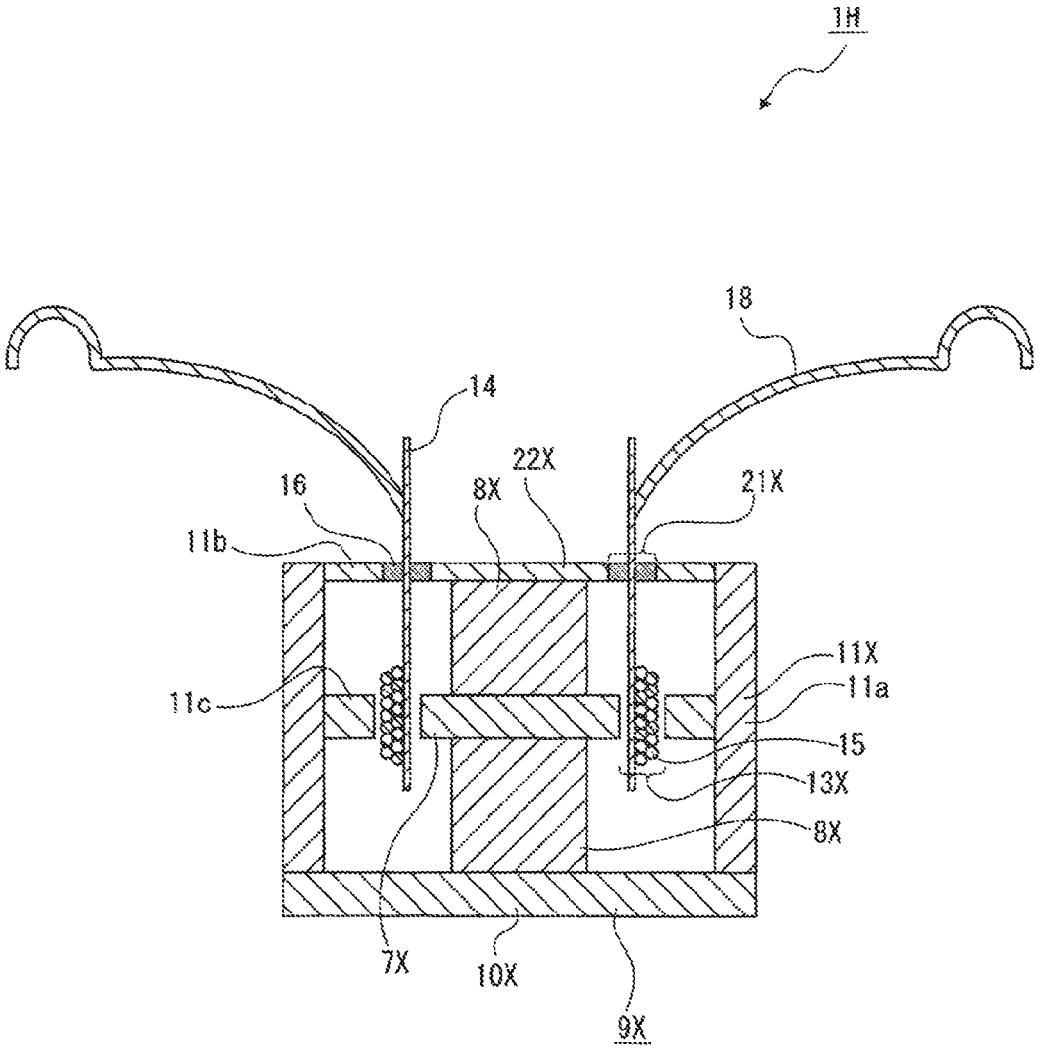
FIG. 15 is an enlarged cross-sectional view illustrating a configuration of a speaker device of a ninth embodiment.

The speaker device 1H of the ninth embodiment will be described with reference to FIG. 15.

The speaker device 1H has magnets 8X and 8X, a yoke 9X, and a sub-plate 22X.

A center portion of the yoke 9X is attached to a rear surface of a rear magnet 8X. The yoke 9X has a disc-shaped base surface portion 10X and a circumferential surface portion 11X that protrudes forward from an outer circumferential portion of the base surface portion 10X. The circumferential surface portion 11X includes a cylindrical portion 11*a*, a front flange portion 11*b* that projects inward from a front end portion of the cylindrical portion 11*a*, and a rear flange portion 11*c* that projects inward from a center portion of the cylindrical portion 11*a* in a front-rear direction.

The magnets 8X and 8X are formed in disc shapes, and a main plate 7X made of a magnetic material is attached to a front surface of the rear magnet 8X. The main plate 7X is formed substantially in a disc shape having a thin thickness. A front magnet 8X is attached to a front surface of the main plate 7X.

A sub-plate 22X made of a magnetic material is attached to a front surface of the front magnet 8X. The sub-plate 22X is formed substantially in a disc shape having a thin thickness.

The main plate 7X, the sub-plate 22X, the magnets 8X and 8X, and the base surface portion 10X of the yoke 9X are combined with one another while central axes thereof are identical to one another.

A space is formed between the main plate 7X and the rear flange portion 11*c* of the yoke 9X, and this space is formed as a main magnetic gap 13X. A space is formed between the sub-plate 22X and the front flange portion 11*b* of the yoke 9X, and this space is formed as a sub-magnetic gap 21X.

A coil bobbin 14 is disposed on an outer circumferential side of the sub-plate 22X and the main plate 7X in a state in which the coil bobbin 14 is changeable (movable) in the front-rear direction. At least a portion of a voice coil 15 wound around the coil bobbin 14 is positioned in the main magnetic gap 13X, and respective portions of the coil bobbin 14 are positioned in the main magnetic gap 13X and the sub-magnetic gap 21X.

In the speaker device 1H, a first magnetic circuit is configured by the main plate 7X, the rear flange portion 11*c* of the yoke 9X, the cylindrical portion 11*a* of the yoke 9X, the base surface portion 10X of the yoke 9X, and the rear magnet 8X. In addition, a second magnetic circuit is configured by the main plate 7X, the rear flange portion 11*c* of the yoke 9X, the cylindrical portion 11*a* of the yoke 9X, the front flange portion 11*b* of the yoke 9X, the sub-plate 22X, and the front magnet 8X.

The sub-magnetic gap 21X is filled with a magnetic fluid 16.

In the speaker device 1H, the voice coil 15 is positioned in the main magnetic gap 13X, and the sub-magnetic gap 21X is filled with a magnetic fluid 16. Thus, when the coil bobbin 14 is changed, the magnetic fluid 16 is rarely scattered, and the amount of the filled magnetic fluid 16 rarely decreases. Further, a stable centering state of the coil bobbin 14 may be ensured.

[Tenth Embodiment]

Figure 16:
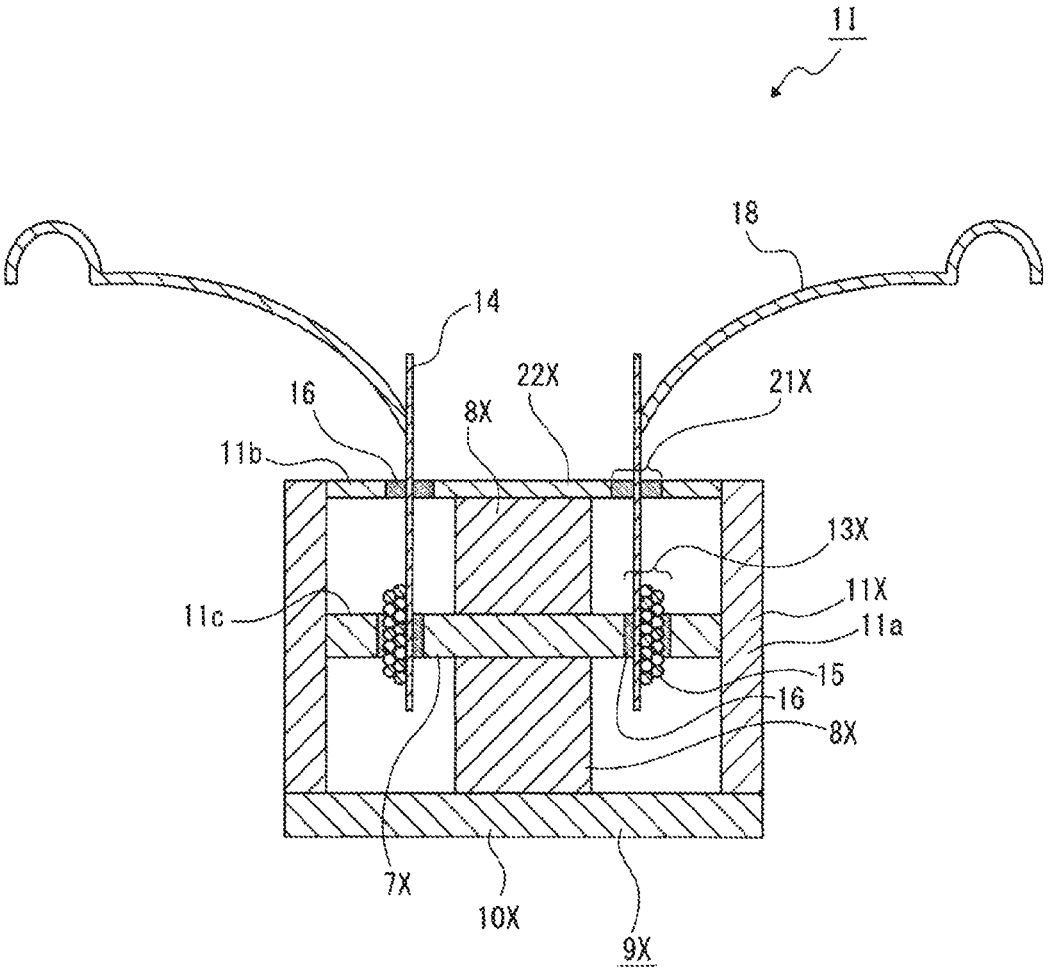
FIG. 16 is an enlarged cross-sectional view illustrating a configuration of a speaker device of a tenth embodiment.

The speaker device 1I of the tenth embodiment will be described with reference to FIG. 16.

Contrary to the speaker device 1H of the ninth embodiment, a main magnetic gap 13X is filled with a magnetic fluid 16 in the present embodiment.

In this way, stability of a vibration operation of a coil bobbin 14 increases when compared to an embodiment in which one magnetic gap is filled with the magnetic fluid 16.

[Eleventh Embodiment]

Figure 17:
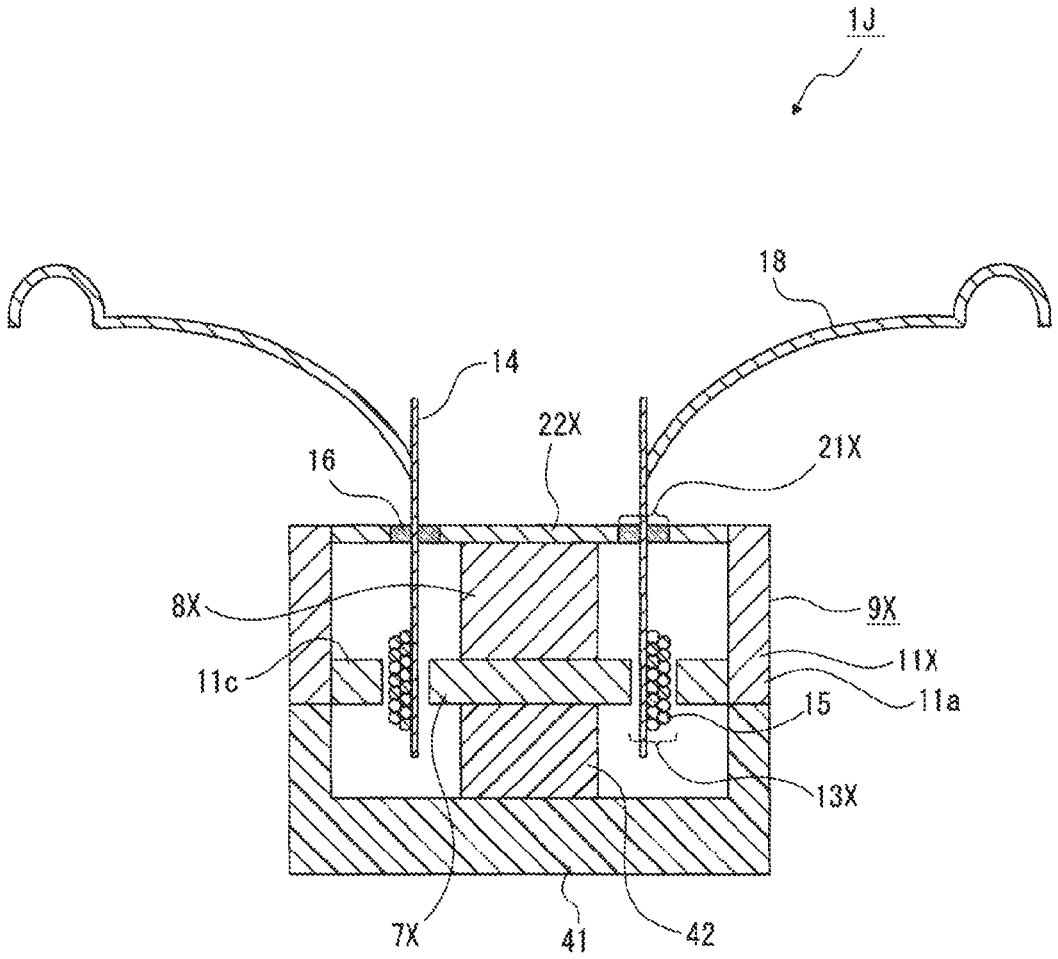
FIG. 17 is an enlarged cross-sectional view illustrating a configuration of a speaker device of an eleventh embodiment.

The speaker device 1J of the eleventh embodiment will be described with reference to FIG. 17.

Contrary to the speaker device 1H of the ninth embodiment, one magnetic circuit is provided in the present embodiment. That is, a columnar member 42 corresponding to a nonmagnetic material is attached to a front side of a center portion of a support frame 41. Further, a yoke 9X is attached to the front side of the support frame 41, and a main plate 7X is attached to a front side of the columnar member 42.

In this way, a magnetic circuit is configured by including one magnet 8X, and thus cost is reduced.

[Twelfth Embodiment]

Figure 18:
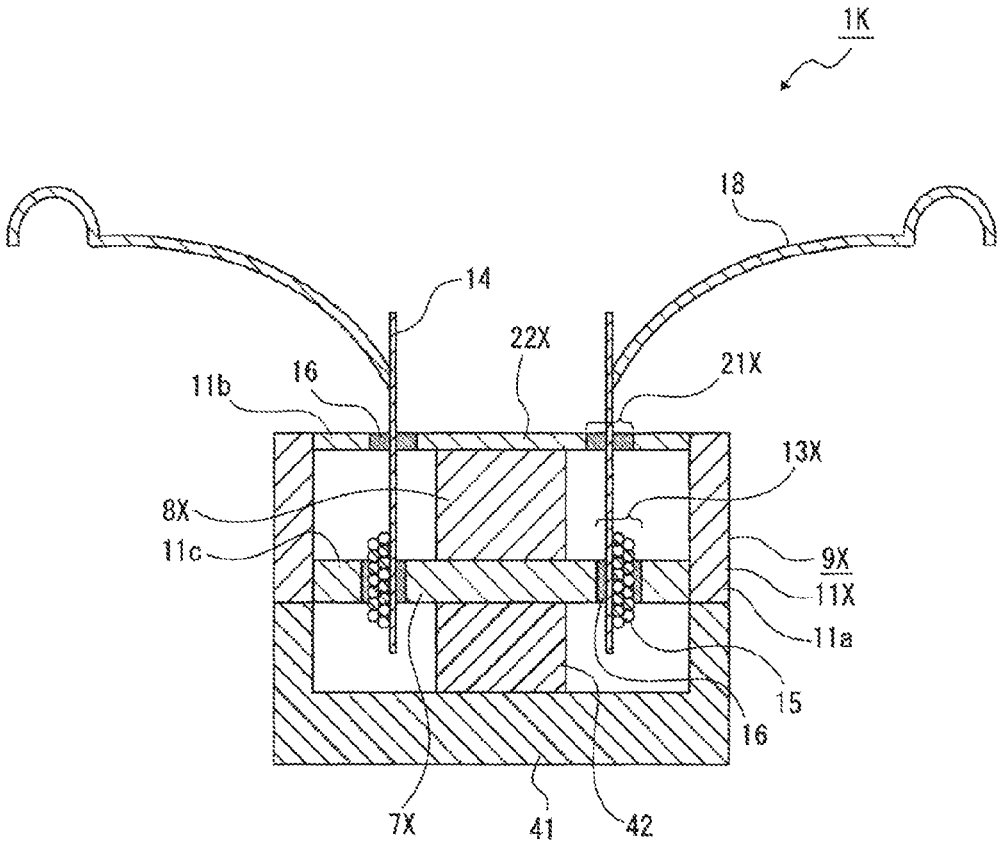
FIG. 18 is an enlarged cross-sectional view illustrating a configuration of a speaker device of a twelfth embodiment.

The speaker device 1K of the twelfth embodiment will be described with reference to FIG. 18.

Contrary to the speaker device 1J of the eleventh embodiment, a main magnetic gap 13X is filled with a magnetic fluid 16 in the present embodiment.

In this way, stability of a vibration operation of a coil bobbin 14 increases when compared to an embodiment in which one magnetic gap is filled with the magnetic fluid 16.

[Thirteenth Embodiment]

Figure 19:
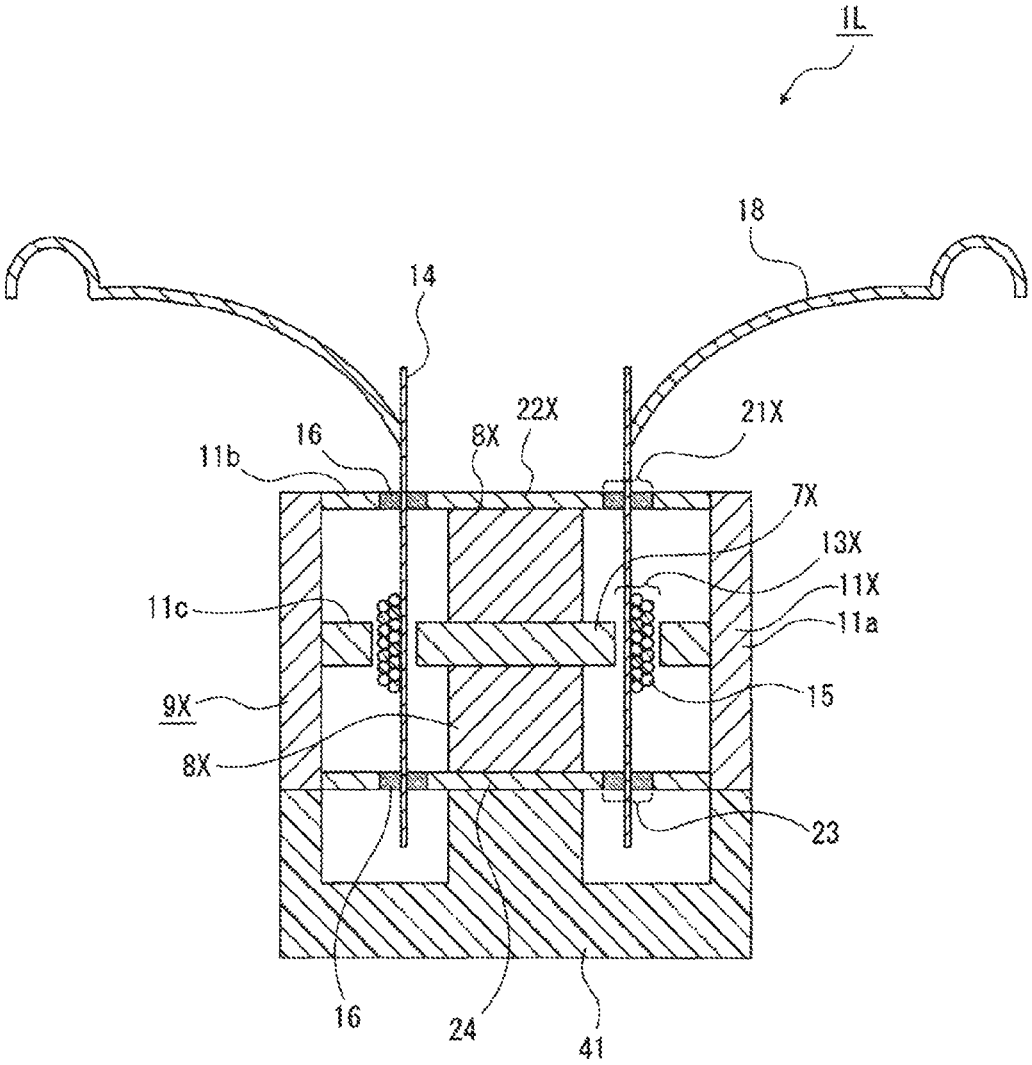
FIG. 19 is an enlarged cross-sectional view illustrating a configuration of a speaker device of a thirteenth embodiment.

The speaker device 1L of the thirteenth embodiment will be described with reference to FIG. 19.

Contrary to the speaker device 1H of the ninth embodiment, one magnetic gap is added as a sub-magnetic gap 23, and the sub-magnetic gap 23 is filled with a magnetic fluid 16 in the present embodiment. A sub-plate 24 is attached to a front side of a support frame 41, and the sub-magnetic gap 23 is formed between the sub-plate 24 and a yoke 9X.

In this way, a sub-magnetic gap 21X and the sub-magnetic gap 23 are filled with magnetic fluids 16 and 16, respectively.

Thus, a coil bobbin 14 is more stably centered.

[Fourteenth Embodiment]

Figure 20:
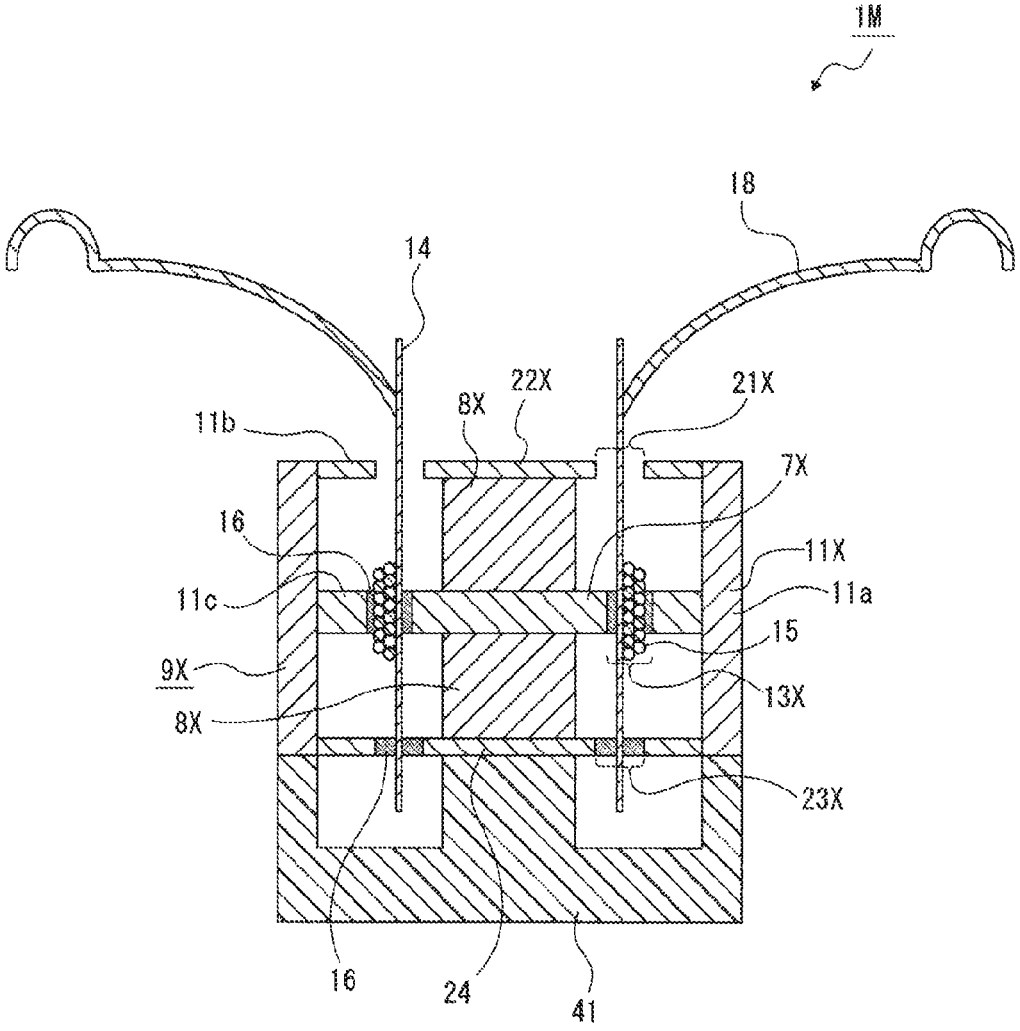
FIG. 20 is an enlarged cross-sectional view illustrating a configuration of a speaker device of a fourteenth embodiment.

The speaker device 1M of the fourteenth embodiment will be described with reference to FIG. 20.

Contrary to the speaker device 1L of the thirteenth embodiment, a sub-magnetic gap 21X is not filled with a magnetic fluid 16, and a main magnetic gap 13X is filled with the magnetic fluid 16 in the present embodiment.

In this way, stability of a vibration operation of a coil bobbin 14 increases when compared to an embodiment in which one sub-magnetic gap is filled with the magnetic fluid 16.

[Fifteenth Embodiment]

Figure 21:
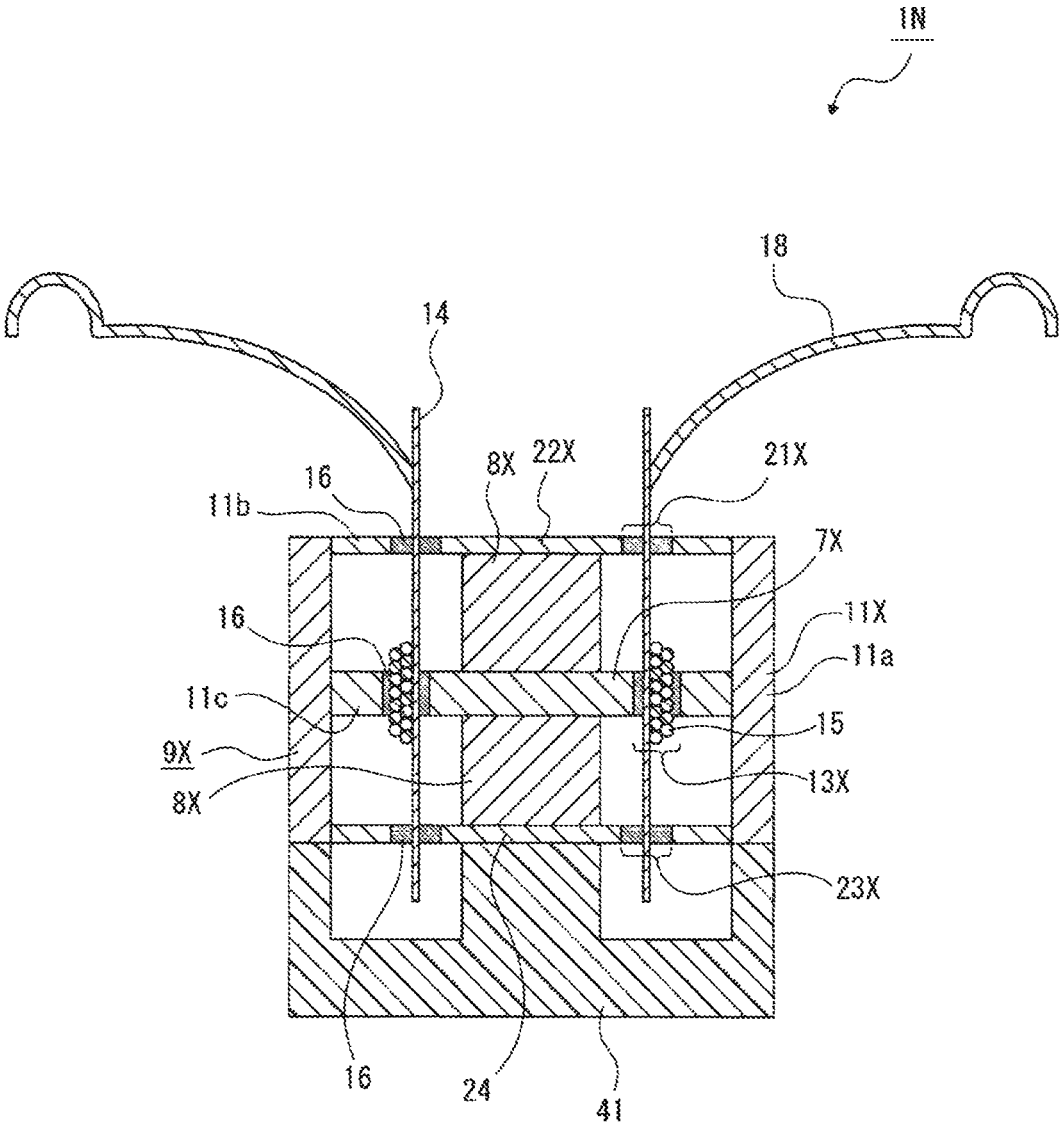
FIG. 21 is an enlarged cross-sectional view illustrating a configuration of a speaker device of a fifteenth embodiment.

The speaker device 1N of the fifteenth embodiment will be described with reference to FIG. 21.

Contrary to the speaker device 1L of the thirteenth embodiment, a main magnetic gap 13X is filled with a magnetic fluid 16 in the present embodiment.

Stability of a vibration operation of a coil bobbin 14 increases.

[Relation Between Magnetic Force Gradient of Sub-Magnetic Gap in Axial Direction and Scattering of Magnetic Fluid]

Hereinafter, a description will be given of a relation between a magnetic force gradient in the axial direction and an operation of the magnetic fluid 16 with respect to an amplitude in the axial direction of the coil bobbin 14 held in the sub-magnetic gap 21 with reference to FIGS. 22A to 22D.

Description below will be given with regard to the speaker device 1 according to the first embodiment as an example.

Figure 22:
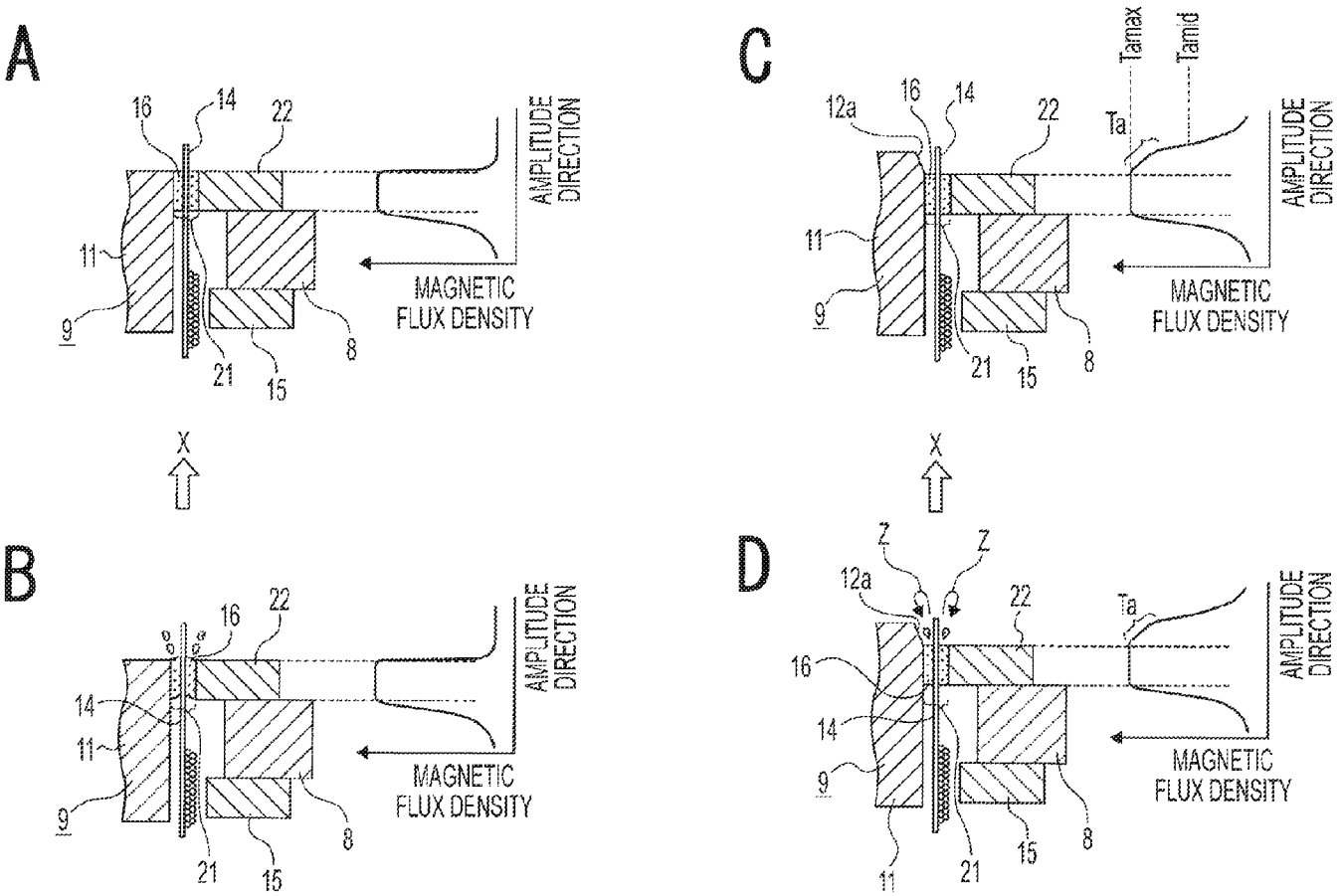
FIGS. 22A to 22D are schematic enlarged cross-sectional views illustrating a state in which a portion of a magnetic fluid is pulled to a side of a magnetic flux change unit that forms a magnetic gradient by changing a magnetic flux density in an axial direction when a coil bobbin is changed.

FIG. 22A illustrates a case in which no gradient of a magnetic flux density is present in an amplitude direction of the sub-magnetic gap 21. A magnetic flux density distribution is nearly symmetric in the amplitude direction. In this case, as illustrated in FIG. 22B, when the coil bobbin 14 changes in an X direction, the magnetic fluid 16 is easily scattered to the outside.

On the other hand, when an inclined plane 12*a* that functions as a magnetic flux change unit is formed in a distal end portion of the yoke 9 (center pole portion 11), a magnetic flux density distribution of the sub-magnetic gap 21 is asymmetric in the amplitude direction, and has a characteristic in that a gradient Ta is included as illustrated in FIG. 22C. In this case, even when the coil bobbin 14 changes in the X direction due to the gradient Ta, and thus the magnetic fluid 16 is scattered, a magnetic flux density is high near the inclined plane 12*a*, and the scattered magnetic fluid 16 is pulled to a side of the magnetic gap 21. Therefore, as illustrated in FIG. 22D, a return z is generated and pulled to the sub-magnetic gap 21, and scattering is suppressed.

[Modified Example 1]

Next, a description will be given of respective modified examples of the magnetic flux change unit that forms a magnetic gradient in the axial direction of the center pole portion 11 of the yoke 9 with reference to FIGS. 23A to 23D and FIGS. 24A to 24C.

The magnetic flux change unit according to the modified examples illustrated below is formed in the sub-plate 22 or the center pole portion 11 of the yoke 19. Hereinafter, description will be given of only different portions of the sub-plate 22 or the center pole portion 11. With regard to the sub-plate 22, the center pole portion 11, and the like similar to that of the speaker device 1 described above, the same reference numeral as that of a similar portion in the speaker device 1 will be applied, and a description thereof will be omitted.

<First Modified Example>

Figure 23:
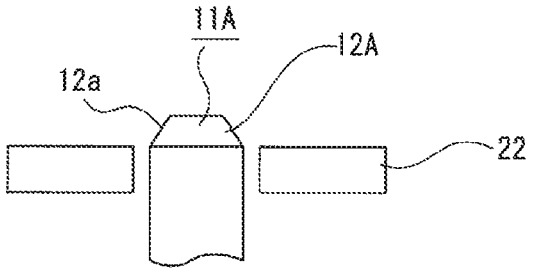
FIGS. 23A to 23D are diagrams illustrating Modified Example 1 of the magnetic flux change unit that forms the magnetic gradient in the axial direction along with FIGS. 24A to 24C, and this figure is a diagram illustrating first to fourth modified examples.
Figure 23:
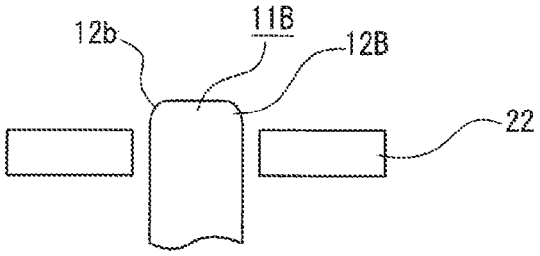
Figure 23:
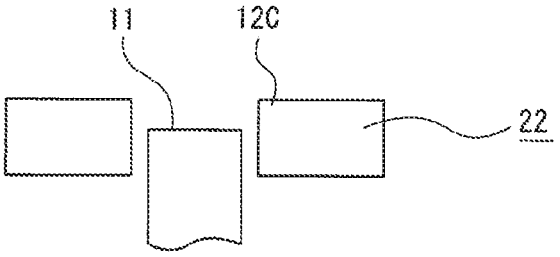
Figure 23:
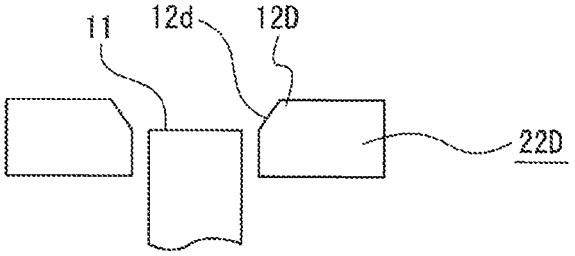

As illustrated in FIG. 23A, a front end portion of a center pole portion 11A is positioned in a state in which the front end portion protrudes forward from a sub-plate 22, and the front end portion of the center pole portion 11A is provided as a magnetic flux change unit 12A according to a first modified example. The magnetic flux change unit 12A is formed in a shape, a diameter of which decreases toward a front side, and an outer circumferential surface thereof is set as an inclined plane 12*a*.

<Second Modified Example>

As illustrated in FIG. 23B, a front end portion of a center pole portion 11B is positioned in a state in which the front end portion protrudes forward from a sub-plate 22, and the front end portion of the center pole portion 11B is provided as a magnetic flux change unit 12B according to a second modified example. The magnetic flux change unit 12B is formed in a shape, a diameter of which decreases toward a front side, and an outer circumferential surface thereof is set as a curved surface 12*b*.

<Third Modified Example>

As illustrated in FIG. 23C, a front surface of a center pole portion 11 is positioned between a front surface and a rear surface of a sub-plate 22. Therefore, a portion on a front end side of the sub-plate 22 is positioned on a front side from the front surface of the center pole portion 11, and the portion on the front end side of the sub-plate 22 is provided as a magnetic flux change unit 12C according to a third modified example.

<Fourth Modified Example>

As illustrated in FIG. 23D, a front surface of a center pole portion 11 is positioned between a front surface and a rear surface of a sub-plate 22D. Therefore, a portion on a front end side of the sub-plate 22D is positioned on a front side from the front surface of the center pole portion 11, and the portion on the front end side of the sub-plate 22D is provided as a magnetic flux change unit 12D according to a fourth modified example. The magnetic flux change unit 12D is formed in a shape, a diameter of which decreases toward a front side, and an inner circumferential surface thereof is set as an inclined plane 12*d* that is displaced outward toward a front side.

<Fifth Modified Example>

Figure 24:
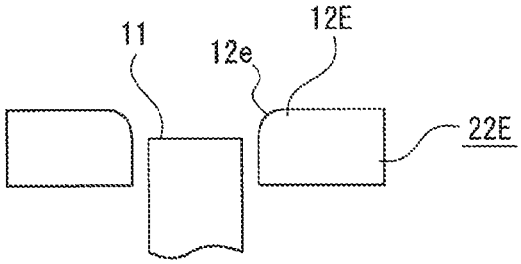
FIGS. 24A to 24C are diagrams illustrating fifth to seventh modified examples.
Figure 24:
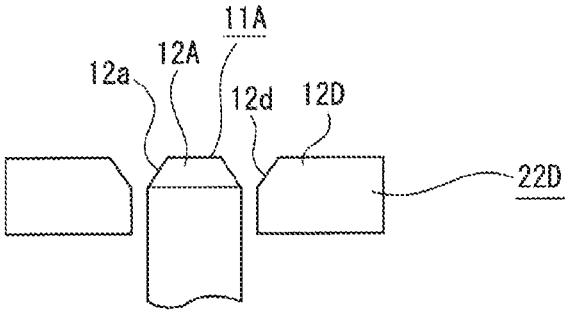
Figure 24:
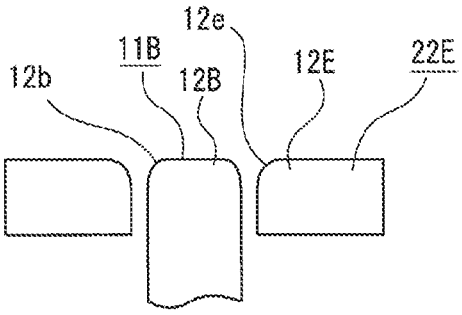
Figure 25:
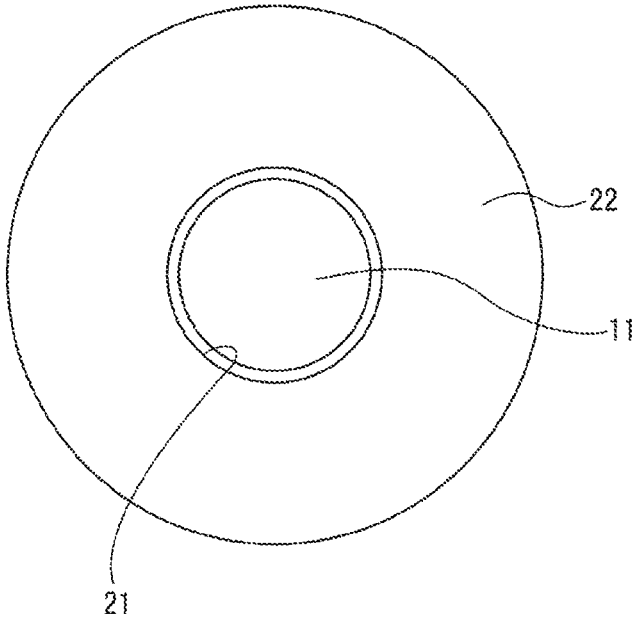
FIGS. 25A and 25B are diagrams illustrating a cross-sectional structure of a sub-plate, a sub-magnetic gap, and a center pole portion.
Figure 25:
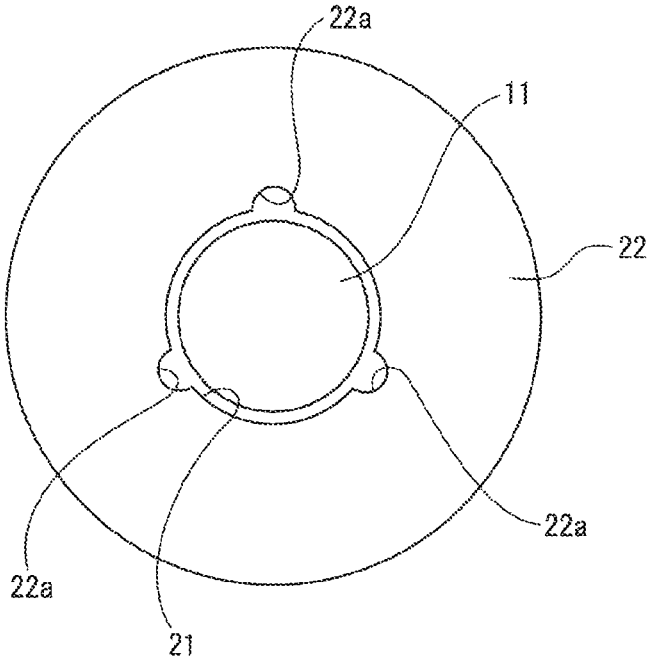

As illustrated in FIG. 24A, a front surface of a center pole portion 11 is positioned between a front surface and a rear surface of a sub-plate 22E. Therefore, a portion on a front end side of the sub-plate 22E is positioned on a front side from the front surface of the center pole portion 11, and the portion on the front end side of the sub-plate 22E is provided as a magnetic flux change unit 12E according to a fifth modified example. The magnetic flux change unit 12E is formed in a shape, a diameter of which decreases toward a front side, and an inner circumferential surface thereof is set as a curved surface 12*e* that is displaced outward toward a front side.

<Sixth Modified Example>

As illustrated in FIG. 24B, a sixth modified example is configured by combining a center pole portion 11A with a sub-plate 22D. A front surface of the center pole portion 11A is positioned on the same plane as a front surface of the sub-plate 22D, and a magnetic flux change unit 12A and a magnetic flux change unit 12D are included.

<Seventh Modified Example>

As illustrated in FIG. 24C, a seventh modified example is configured by combining a center pole portion 11B with a sub-plate 22E. A front surface of the center pole portion 11B is positioned on the same plane as a front surface of the sub-plate 22E, and a magnetic flux change unit 12B and a magnetic flux change unit 12E are included.

As in the sixth modified example and the seventh modified example described above, when the magnetic flux change units 12A and 12B and the magnetic flux change units 12D and 12E are provided in the center pole portions 11A and 11B and the sub-plate 22D and 22E, respectively, a degree of freedom increases with respect to change of a magnetic flux density, and improvement in a design freedom may be attempted.

[Summary of Magnetic Flux Change Unit that Forms Magnetic Gradient in Axial Direction]

As in the first modified example, the fourth modified example, and the sixth modified example described above, when the inclined planes 12*a* and 12*d* are formed, and portions in which the inclined planes 12*a* and 12*d* are formed are provided as the magnetic flux change units 12A and 12D, a magnetic gradient may be easily formed after ensuring simplicity of a shape of the center pole portion 11A or the sub-plate 22D.

In addition, as in the second modified example, the fifth modified example, and the seventh modified example described above, when the curved surfaces 12*b* and 12*e* are formed, and portions in which the curved surfaces 12*b* and 12*e* are formed are provided as the magnetic flux change units 12B and 12E, a magnetic gradient may be easily formed after ensuring simplicity of a shape of the center pole portion 11B or the sub-plate 22E.

[Relation Between Magnetic Force Gradient of Sub-Magnetic Gap in Circumferential Direction and Scattering of Magnetic Fluid]

Hereinafter, a description will be given of a relation between a magnetic force gradient of the sub-magnetic gap 21 in the circumferential direction and scattering of the magnetic fluid 16 with reference to FIG. 25A to FIG. 27.

FIGS. 25A and 25B illustrate a cross-sectional structure of the sub-plate 22, the sub-magnetic gap 21, and the center pole portion 11. FIG. 25A illustrates a case in which there is no magnetic force gradient in the circumferential direction. As illustrated in FIG. 25A, the center pole portion 11 is located at a center position, and the sub-magnetic gap 21 and the sub-plate 22 are located around the center pole portion 11.

Figure 26:
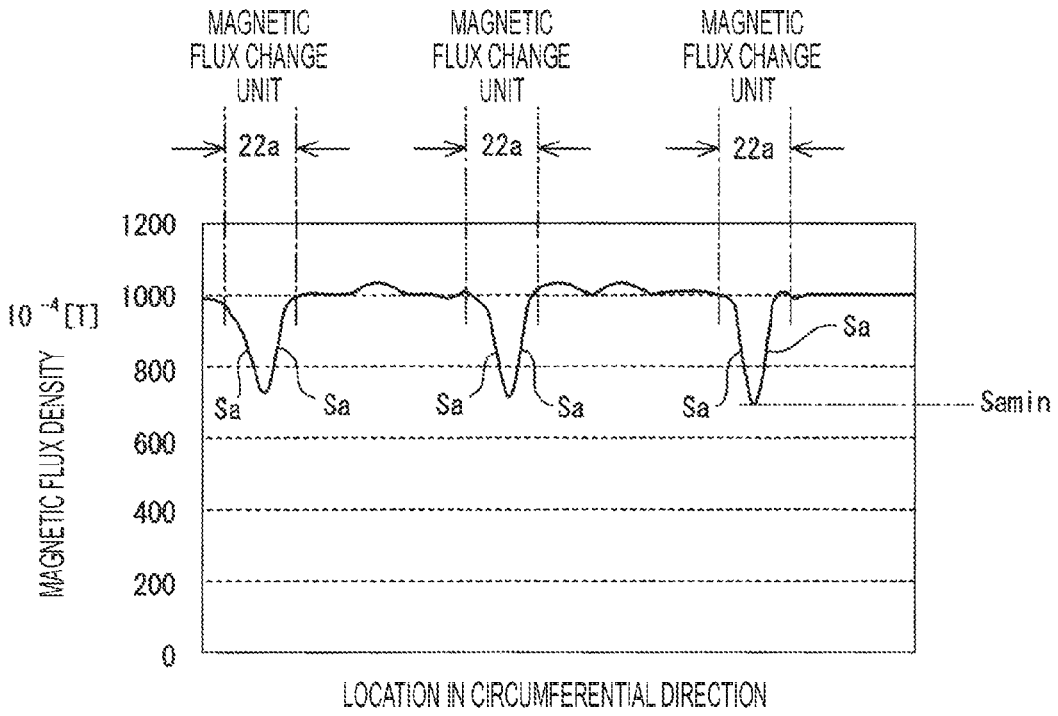
FIG. 26 is a graph illustrating a magnetic flux density of the magnetic gap in a circumferential direction.
Figure 26:
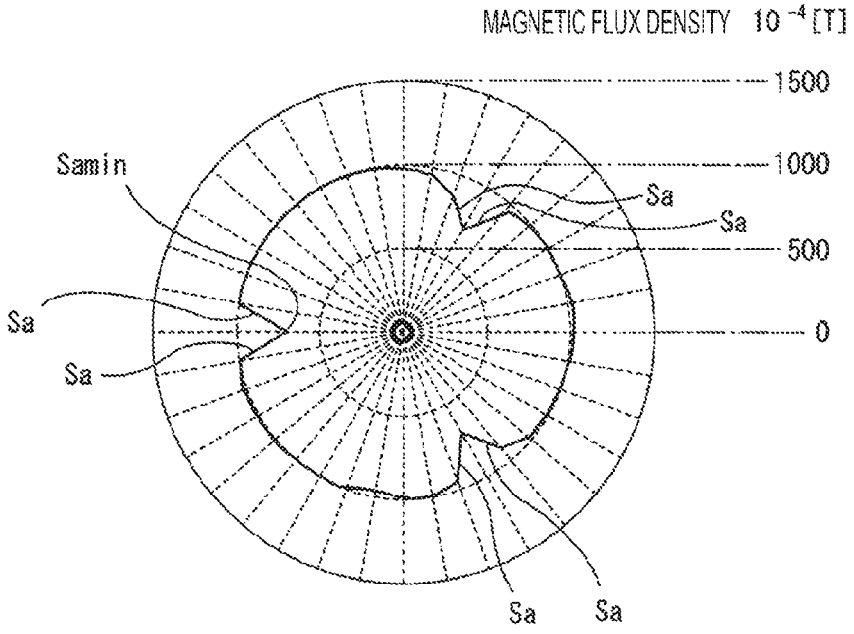

FIG. 25B illustrates a case in which a magnetic force gradient is generated. As illustrated in FIG. 25B, magnetic flux change units 22*a*, 22*a*, and 22*a* are formed in the sub-plate 22. FIG. 26 is a graph illustrating a magnetic flux density of the sub-magnetic gap 21 in the circumferential direction. As illustrated in FIG. 26, in portions in which the magnetic flux change units 22*a*, 22*a*, and 22*a* of the sub-plate 22 are formed, magnetic gradients (inclined portions) Sa, Sa, . . . are formed by the magnetic flux change units 22*a*, 22*a*, and 22*a*, and magnetic forces are smaller than those of other portions. The magnetic gradient Sa indicates a change in magnetic flux density in which, even though a magnetic force is present, the magnetic force decreases toward a portion close to a center of the magnetic flux change unit 22*a* in the circumferential direction.

As illustrated in FIG. 26, the magnetic flux change units 22*a*, 22*a*, and 22*a* of the sub-plate 22 have functions of forming the magnetic gradients Sa, Sa, . . . that change magnetic forces with respect to the magnetic fluid 16 by changing the magnetic flux density of the sub-magnetic gap 21 in the circumferential direction. Therefore, the magnetic fluid 16 filling the sub-magnetic gap 21 is held in a portion in which a magnetic flux density is high, and gaps 21*a*, 21*a*, and 21*a* in which the magnetic fluid 16 is not present are formed between the outer circumferential surface of the center pole portion 11 and the inner circumferential surface of the sub-plate 22 in the portions in which the magnetic flux change units 22*a*, 22*a*, and 22*a* are formed, respectively (see FIG. 27).

[Magnetic Gradient in Axial Direction and Circumferential Direction]

As described in the foregoing, in an embodiment of the speaker device 1, the magnetic flux change unit 12 (12A, 12B, . . . ) is formed in the center pole portion 11 of the yoke 9. The magnetic flux change unit 12 of the center pole portion 11 has a function of forming a magnetic gradient Ta that changes a magnetic force with respect to the magnetic fluid 16 by changing a magnetic flux density in the axial direction, that is, a direction in which the coil bobbin 14 changes (see FIGS. 22A to 22D).

In the speaker device 1, a minimum value Samin of a magnetic flux density in the circumferential direction (see FIG. 26) is larger than a value Tamid (see FIG. 22C) corresponding to half a maximum value Tamax (see FIG. 22C) of the magnetic flux density in the axial direction.

Figure 27:
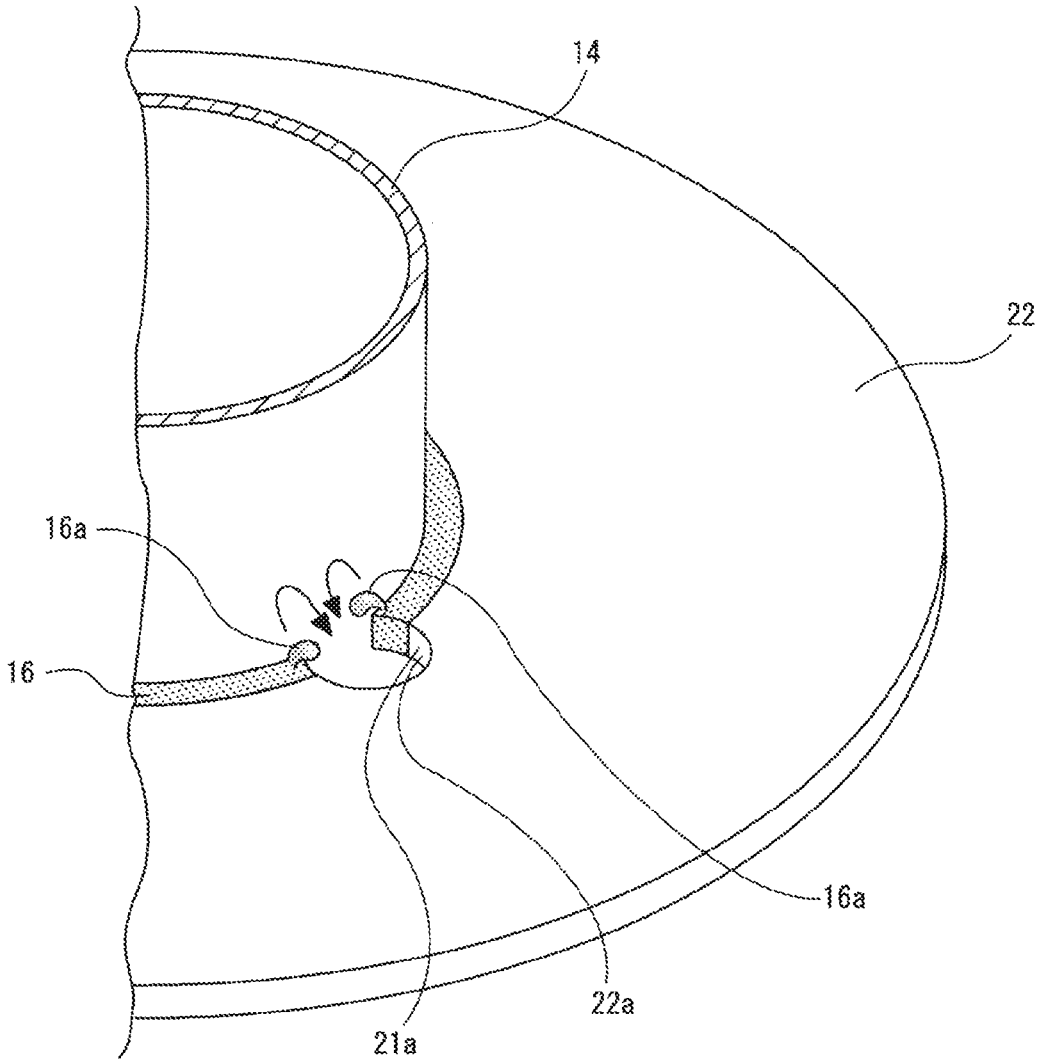
FIG. 27 is a schematic enlarged cross-sectional view illustrating a state in which a portion of the magnetic fluid is pulled to a side of the magnetic flux change unit that forms a magnetic gradient by changing a magnetic flux density in the circumferential direction when the coil bobbin is changed.

Therefore, as illustrated in FIG. 27, portions 16*a*, 16*a*, . . . of the magnetic fluid 16 to be likely to be scattered in the axial direction or the circumferential direction are pulled to the sub-magnetic gap 21 from the gaps 21*a*, 21*a*, and 21*a* corresponding to portions having magnetic forces in which the magnetic gradients Sa, Sa, . . . are formed, and scattering is suppressed.

[Modified Example 2]

Hereinafter, a description will be given of respective modified examples of the magnetic flux change unit that forms a magnetic gradient in the circumferential direction of the center pole portion of the yoke with reference to FIG. 28 and FIGS. 29A and 29B.

The magnetic flux change unit according to the modified examples illustrated below is formed in the sub-plate or the center pole portion of the yoke. Hereinafter, description will be given of only different portions of the sub-plate 22 or the center pole portion 11. With regard to the sub-plate or the center pole portion similar to that of the speaker device 1 described above, the same reference numeral as that of a similar portion in the speaker device 1 will be applied, and a description thereof will be omitted.

<First Modified Example>

Figure 28:
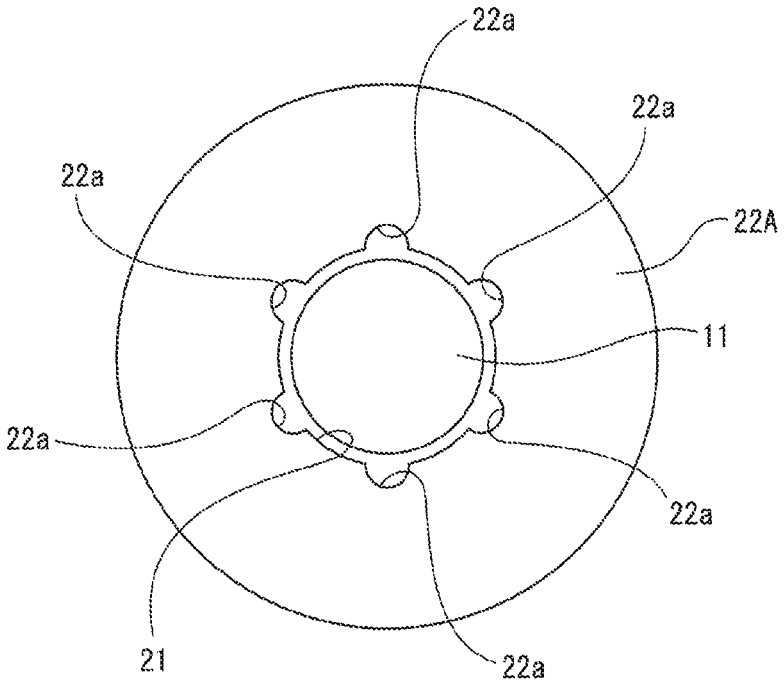
FIG. 28 is a diagram illustrating Modified Example 2 of the magnetic flux change unit that forms the magnetic gradient in the circumferential direction along with FIGS. 29A and 29B, and this figure is a diagram illustrating a first modified example.

As illustrated in FIG. 28, for example, six depressions separated from one another at equal intervals in a circumferential direction are formed on an inner circumferential surface of a sub-plate 22A, and the respective depressions are formed as magnetic flux change units 22*a*, 22*a*, . . . according to a first modified example. The respective magnetic flux change units 22*a*, 22*a*, . . . are formed while extending in a front-rear direction.

An arbitrary number of magnetic flux change units 22*a* may be provided. Five or fewer magnetic flux change units 22*a* may be provided or seven or more magnetic flux change units 22*a* may be provided.

In addition, for example, a cross-sectional shape of each magnetic flux change unit 22*a* perpendicular to an axial direction is formed in a substantially semicircular shape. However, the cross-sectional shape may be formed in another shape such as a triangular shape, a quadrangular shape, and the like.

<Second Modified Example>

Figure 29:
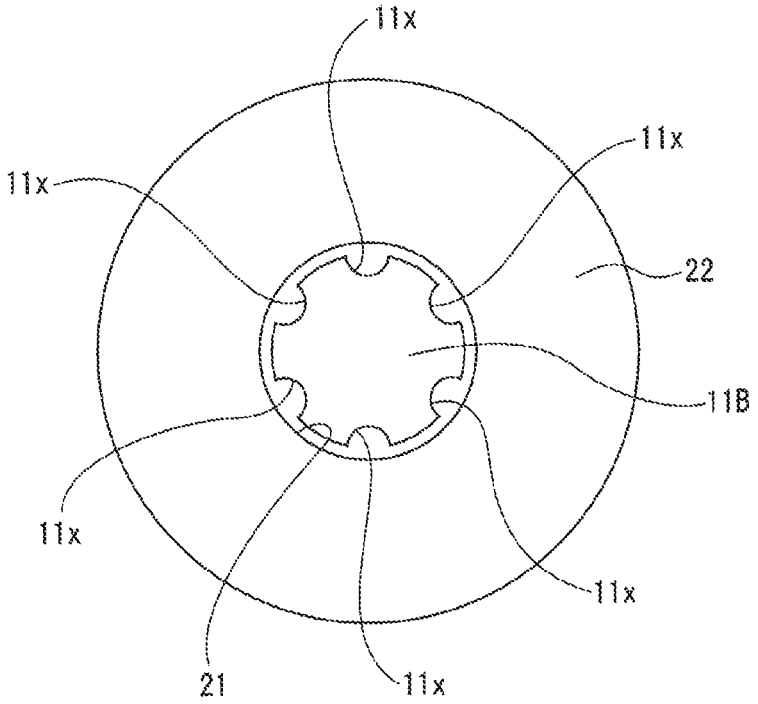
FIGS. 29A and 29B are diagrams illustrating second and third modified examples.
Figure 29:
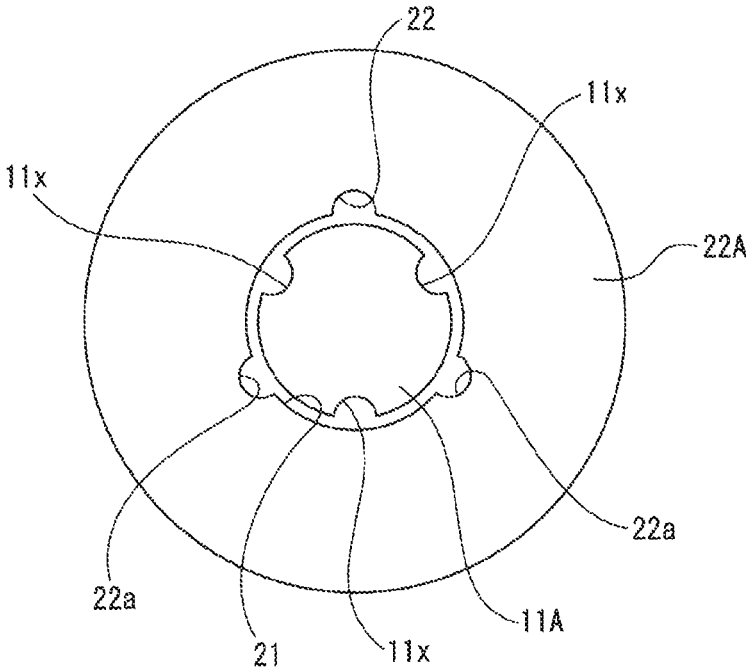

As illustrated in FIG. 29A, for example, six depressions separated from one another at equal intervals in a circumferential direction are formed on an outer circumferential surface of a center pole portion 11B, and the respective depressions are formed as magnetic flux change units 11*x*, 11*x*, . . . according to a second modified example. The respective magnetic flux change units 11*x*, 11*x*, . . . are formed while extending in a front-rear direction. Any magnetic flux change unit is not formed in a sub-plate 22.

An arbitrary number of magnetic flux change units 11*x* may be provided. Five or fewer magnetic flux change units 11*x* may be provided or seven or more magnetic flux change units 11*x* may be provided.

In addition, for example, a cross-sectional shape of each magnetic flux change unit 11*x* perpendicular to an axial direction is formed in a substantially semicircular shape. However, the cross-sectional shape may be formed in another shape such as a triangular shape, a quadrangular shape, and the like.

<Third Modified Example>

A third modified example is configured by combining the sub-plate 22A with the center pole portion 11A. As illustrated in FIG. 29B, the third modified example includes magnetic flux change units 22*a*, 22*a*, and 22*a* formed to be separated from one another at equal intervals in a circumferential direction, and magnetic flux change units 11*x*, 11*x*, and 11*x* formed to be separated from one another at equal intervals in the circumferential direction. The magnetic flux change units 22*a*, 22*a*, and 22*a* and the magnetic flux change units 11*x*, 11*x*, and 11*x* are alternately positioned in the circumferential direction.

An arbitrary number of magnetic flux change units 22*a* and an arbitrary number of magnetic flux change units 11*x* may be provided. Two or fewer magnetic flux change units 22*a* and two or fewer magnetic flux change units 11*x* may be provided. In addition, four or more magnetic flux change units 22*a* and four or more magnetic flux change units 11*x* may be provided.

Further, for example, a cross-sectional shape of each of the magnetic flux change unit 22*a* and the magnetic flux change unit 11*x* perpendicular to an axial direction is formed in a substantially semicircular shape. However, the cross-sectional shape may be formed in another shape such as a triangular shape, a quadrangular shape, and the like.

In this way, when the magnetic flux change units 22*a*, 22*a*, and 22*a* and the magnetic flux change units 11*x*, 11*x*, and 11*x* are formed in the sub-plate 22A and the center pole portion 11A, respectively, a degree of freedom increases with respect to change of a magnetic flux density, and improvement in a design freedom may be attempted.

In addition, when the magnetic flux change units 22*a*, 22*a*, and 22*a* formed on an inner circumferential surface of the sub-plate 22A and the magnetic flux change units 11*x*, 11*x*, and 11*x* formed on an outer circumferential surface of the center pole portion 11A are alternately positioned in the circumferential direction, a magnetic flux changes at many positions in the circumferential direction in a well-balanced manner. Thus, an excellent magnetic balance may be ensured, and the coil bobbin 14 may be smoothly displaced.

[Summary of Magnetic Flux Change Unit that Forms Magnetic Gradient in Circumferential Direction]

As described in the foregoing, when a plurality of magnetic flux change units 22*a*, 22*a*, . . . or a plurality of magnetic flux change units 11*x*, 11*x*, . . . is formed to be separated to one another in the circumferential direction, the magnetic flux change units 22*a*, 22*a*, . . . or the magnetic flux change units 11*x*, 11*x*, . . . are symmetric. Thus, an excellent magnetic balance may be ensured, and the coil bobbin 14 may be smoothly displaced.

In addition, depressions extending in the axial direction are formed as the magnetic flux change units 22*a*, 22*a*, . . . and the magnetic flux change units 11*x*, 11*x*, . . . . Thus, the magnetic flux change units 11*x*, 11*x*, . . . and the magnetic flux change units 11*x*, 11*x*, . . . may be easily formed, and miniaturization of the speaker device 1 may be attempted without increase in an external diameter of the speaker device 1.

[Description of Through-Holes]

The through-holes 14*a*, 14*a*, . . . formed in the coil bobbin 14 (see FIG. 1) are preferably formed at positions that allow a flow of the magnetic fluid 16 between the sub-plate 22 and the center pole portion 11 in a range of a variation in the axial direction toward the coil bobbin 14. The allowing positions refer to positions at which the through-holes 14*a*, 14*a*, . . . are present at positions at which the magnetic fluid 16 is present at all times even when the coil bobbin 14 changes in the axial direction.

As described in the foregoing, when the through-hole 14*a* is formed, the magnetic fluid 16 flows between the sub-plate 22 and the center pole portion 11 of the yoke 9 through the through-hole 14*a*. Therefore, excellent fluidity of the magnetic fluid 16 may be ensured, and thus accuracy of centering of the coil bobbin 14 may be improved, distortion of an input may be sufficiently reduced, and a stable signal reproduction operation may be ensured.

Shapes of the through-holes 14*a*, 14*a*, . . . may correspond to a shape such as a round shape, an angular, a slit shape, a curved slit shape, and the like.

[Modified Example 3]

Next, a description will be given of respective modified examples related to the through-hole formed in the coil bobbin 14.

[First Modified Example]

Figure 30:
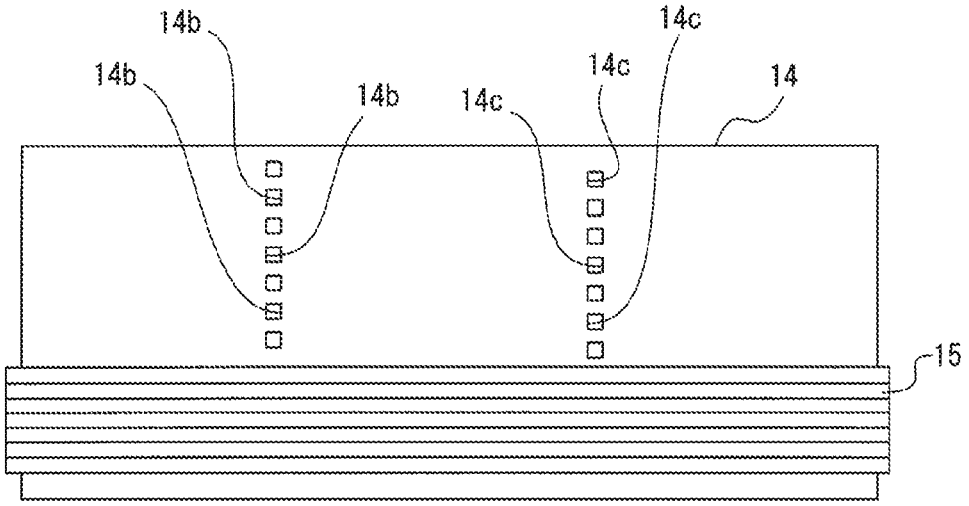
FIG. 30 is a diagram illustrating Modified Example 3 of a state in which a through-hole is formed along with FIGS. 31A and 31B, and this figure is a development view illustrating the first modified example.

In a first modified example, as illustrated in FIG. 30, for example, a plurality of through-holes 14*b*, 14*b*, . . . separated from one another at equal intervals and a plurality of through-holes 14*c*, 14*c*, . . . separated from one another at equal intervals are positioned in an axial direction of a coil bobbin 14, and the through-holes 14*b*, 14*b*, . . . are formed to be shifted from the through-holes 14*c*, 14*c*, . . . in the axial direction. For example, the through-holes 14*b*, 14*b*, . . . and the through-holes 14*c*, 14*c*, . . . are formed in rectangular shapes.

In this way, when the through-holes 14*b*, 14*b*, . . . and the through-holes 14*c*, 14*c*, . . . are positioned to be separated from one another in the axial direction of the coil bobbin 14, respectively, a magnetic fluid 16 easily flows through either the through-holes 14*b*, 14*b*, . . . or the through-holes 14*c*, 14*c*, . . . when the coil bobbin 14 is changed in the axial direction.

In addition, when the through-holes 14*b*, 14*b*, . . . are formed to be shifted from the through-holes 14*c*, 14*c*, . . . in the axial direction, at least one of the through-holes 14*b*, 14*b*, . . . or the through-holes 14*c*, 14*c*, . . . is located at a position at which the magnetic fluid 16 is present, and thus the magnetic fluid 16 more easily flows.

<Second Modified Example>

Figure 31:
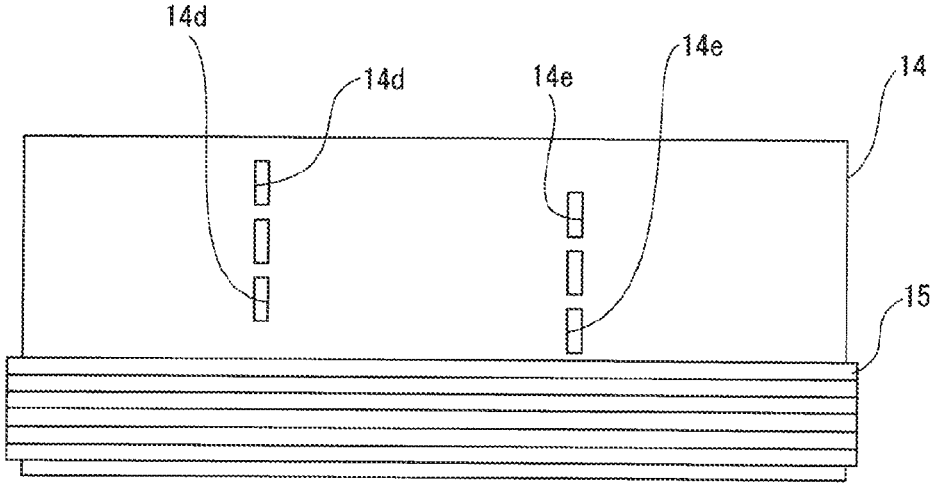
FIGS. 31A and 31B are development views illustrating second and third modified examples.
Figure 31:
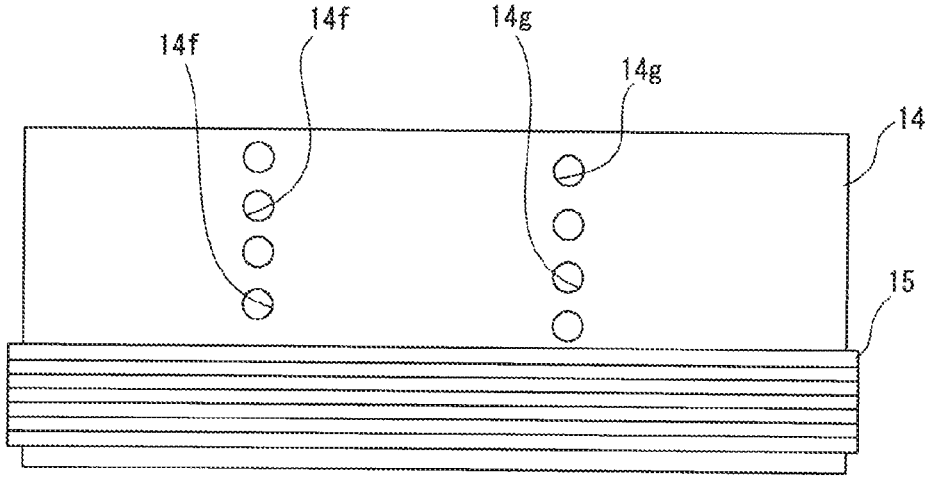

In a second modified example, as illustrated in FIG. 31A, for example, a plurality of through-holes 14*d*, 14*d*, . . . separated from one another at equal intervals and a plurality of through-holes 14*e*, 14*e*, . . . separated from one another at equal intervals are positioned in an axial direction of a coil bobbin 14, the through-holes 14*d*, 14*d*, . . . are formed to be shifted from the through-holes 14*e*, 14*e*, . . . in the axial direction, and the through-holes 14*d*, 14*d*, . . . and the through-holes 14*e*, 14*e*, . . . are formed in slit shapes that extend in the axial direction.

In the second modified example, the through-holes 14*d*, 14*d*, . . . and the through-holes 14*e*, 14*e*, . . . are formed in the slit shapes that extend in the axial direction, and thus a magnetic fluid 16 more easily flows through either the through-holes 14*d*, 14*d*, . . . or the through-holes 14*e*, 14*e*, . . . when the coil bobbin 14 is changed in the axial direction.

<Third Modified Example>

In a third modified example, as illustrated in FIG. 31B, for example, a plurality of through-holes 14*f*, 14*f*, . . . separated from one another at equal intervals and a plurality of through-holes 14*g*, 14*g*, . . . separated from one another at equal intervals are positioned in an axial direction of a coil bobbin 14, the through-holes 14*f*, 14*f*, . . . are formed to be shifted from the through-holes 14*g*, 14*g*, . . . in the axial direction, and the through-holes 14*f*, 14*f*, . . . and the through-holes 14*g*, 14*g*, . . . are formed in circular shapes.

In the third modified example, when the coil bobbin 14 is changed in the axial direction, a magnetic fluid 16 easily flows through either the through-holes 14*f*, 14*f*, . . . or the through-holes 14*g*, 14*g*, . . . . In addition, since the through-holes 14*f*, 14*f*, . . . and the through-holes 14*g*, 14*g*, . . . are formed in the circular shapes, stress concentration rarely occurs at opening edges of the through-holes 14*f*, 14*f*, . . . and the through-holes 14*g*, 14*g*, . . . , and a high rigidity of the coil bobbin 14 may be ensured.

[Support Ring]

Hereinafter, a description will be given of a support ring 25 installed on the sub-plate 22 with reference to FIGS. 32A to 32C and FIG. 33.

Figure 32:
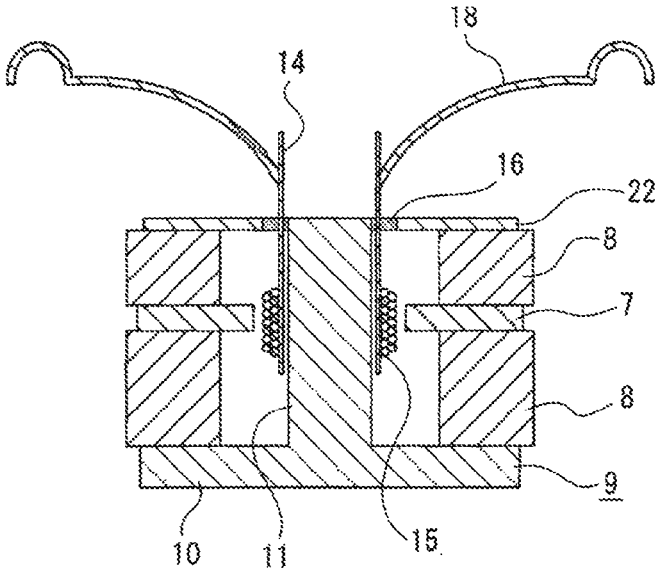
FIGS. 32A to 32C are conceptual diagrams illustrating a configuration of the speaker device and a support ring.
Figure 32:
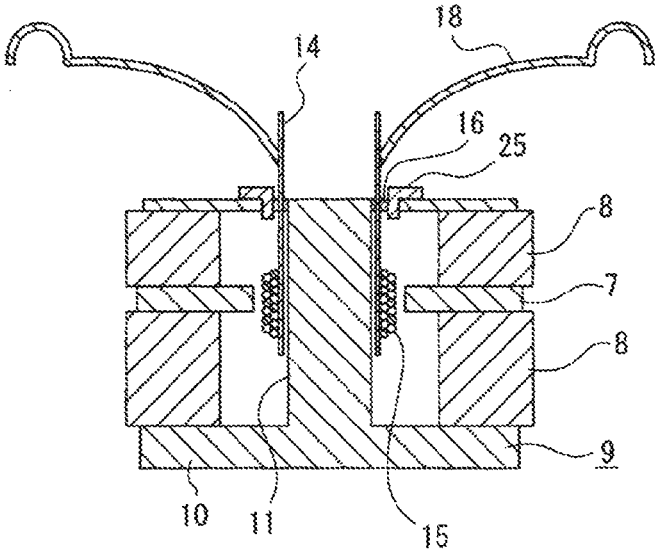
Figure 32:
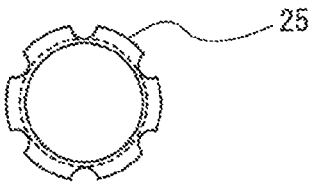

FIG. 32A is a conceptual diagram illustrating a configuration of the speaker device 1 on which the support ring 25 is not installed, and FIG. 32B is a conceptual diagram illustrating a configuration of the speaker device 1 on which the support ring 25 is installed.

When the coil bobbin 14 is installed in assembly of the speaker device 1, the coil bobbin 14 is installed by being inserted into the sub-plate 22 from a front side of the speaker device 1. A radius of a center portion of the sub-plate 22 is larger than an outer circumference (external diameter) of the voice coil 15. In this way, the voice coil 15 may smoothly pass through the sub-magnetic gap 21 which is formed on an inner circumferential side of the sub-plate 22.

However, when a size of a center hole of the sub-plate 22 is determined in consideration of the external diameter of the voice coil 15, the center hole of the sub-plate 22 becomes large, and the coil bobbin 14 is smoothly installed. However, there is concern that a function of holding the magnetic fluid 16 may become unstable due to decrease in magnetic flux density that holds the magnetic fluid 16, and centering effect of the coil bobbin 14 may be insufficient. In addition, the amount of the filled magnetic fluid 16 increases, and production cost increases.

In the regard, as illustrated in FIG. 32B and FIG. 32C, the sub-magnetic gap 21 may be made small by attaching the support ring 25 to an inner circumferential portion of the sub-plate 22 after the coil bobbin 14 is inserted into the center hole of the sub-plate 22.

In this way, the function of holding the magnetic fluid 16 may become stable.

Figure 33:
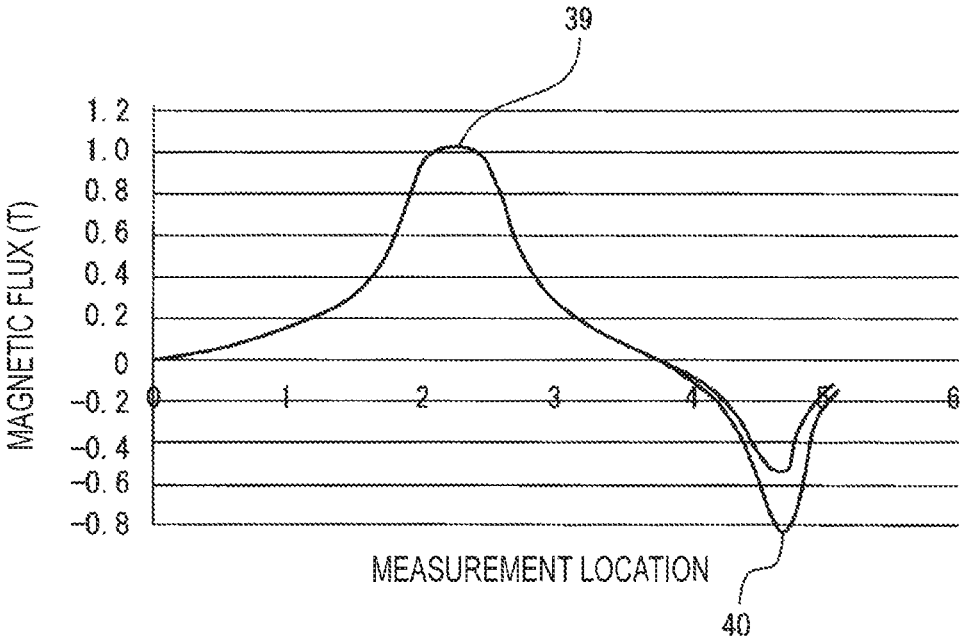
FIG. 33 is a graph illustrating a magnetic force distribution when the support ring is installed and when the support ring is not installed.
Figure 34:
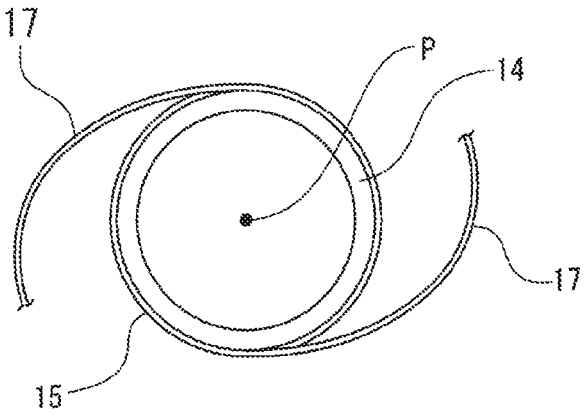
FIGS. 34A and 34B are diagrams illustrating Modified Example 4 of a state in which a lead wire and the like are arranged with respect to a coil bobbin along with FIGS. 35A and 33B and FIG. 36, and this figure is an enlarged front view illustrating first and second modified examples.
Figure 34:
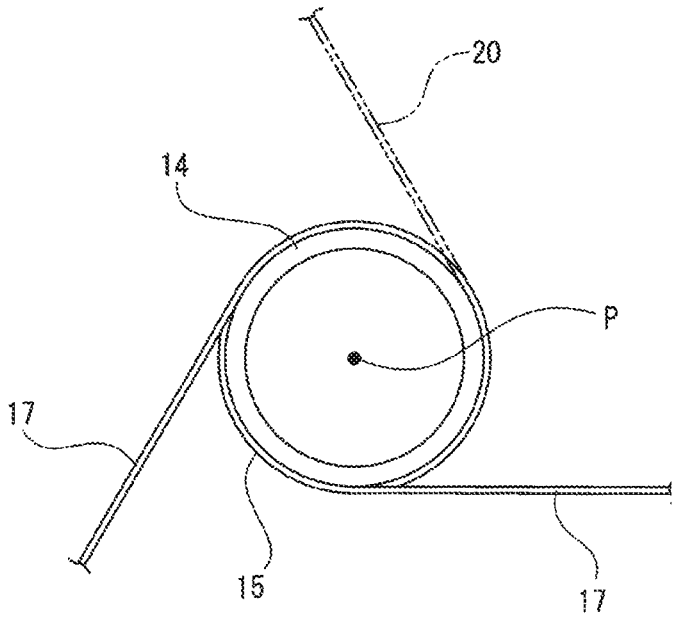
Figure 35:
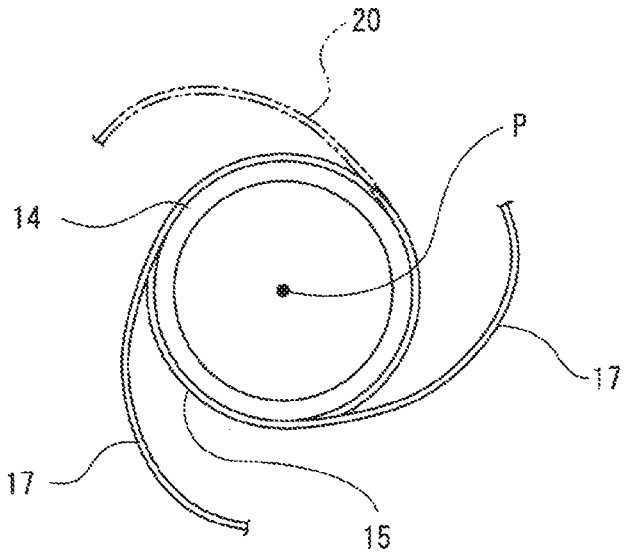
FIGS. 35A and 35B are enlarged front views illustrating third and fourth modified examples.
Figure 35:
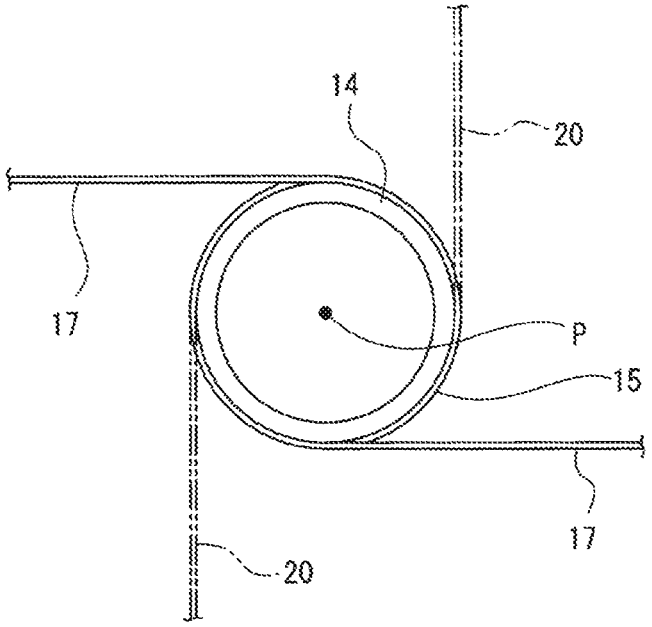

The support ring 25 is preferably made of a magnetic material. When the support ring 25 is formed using the magnetic material, a value of a magnetic flux density of the sub-magnetic gap 21 may be increased to a peak value 40 (see FIG. 33). A peak value 39 illustrated in FIG. 33 is a value of a magnetic flux density of the main magnetic gap 13.

In addition, the support ring 25 may be made of a nonmagnetic material. In this case, even though there is no effect that a magnetic flux density is increased, stability of centering effect of the coil bobbin 14 may be improved, and the amount of the filled magnetic fluid 16 may be reduced.

[Arrangement of Lead Wire, and the Like with Respect to Coil Bobbin]

Figure 2:
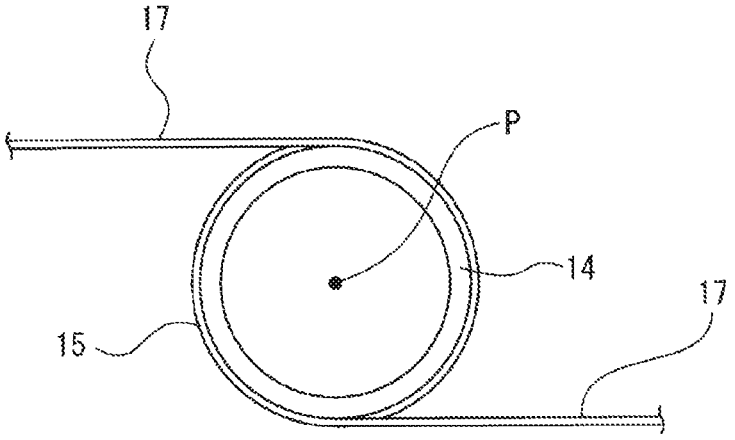
FIG. 2 is a conceptual diagram illustrating a state of a lead wire.

As described in the foregoing, the both end portions of the voice coil 15 are connected to the terminals 6 and 6 by the lead wires 17 and 17, respectively (see FIG. 2). The lead wires 17 and 17 are attached to the coil bobbin 14 while being symmetrically disposed about the central axis P of the coil bobbin 14. For example, the lead wires 17 and 17 are disposed in linear shapes.

In this way, tensile forces are applied to the coil bobbin 14 in substantially opposite directions at 1800 to each other by the lead wires 17 and 17, and a so-called rolling phenomenon in which the coil bobbin 14 is inclined to a direction in which a shaft falls rarely occurs when the coil bobbin 14 is changed.

An arbitrary number of lead wires 17 may be provided when a plurality of lead wires 17 is provided, and three or more lead wires 17 may be provided.

[Modified Example 4]

Next, a description will be given of respective modified examples related to a state in which the lead wire and the like are arranged with respect to the coil bobbin with reference to FIG. 34A to FIG. 36.

With regard to the modified examples described below, only the lead wire and the like will be described. The same reference numeral as that in the speaker device 1 will be applied to the coil bobbin around which the voice coil connected to the lead wire and the like is wound, and a description thereof will be omitted.

<First Modified Example>

In a first modified example, as illustrated in FIG. 34A, two lead wires 17 and 17 are attached to a coil bobbin 14 while being symmetrically disposed about a central axis P of the coil bobbin 14 with respect to the coil bobbin 14, and the lead wires 17 and 17 are disposed in curved shapes. Three or more lead wires 17 may be disposed when the lead wires 17 are symmetrically disposed about the central axis P of the coil bobbin 14.

<Second Modified Example>

In a second modified example, as illustrated in FIG. 34B, two lead wires 17 and 17 and one connecting wire 20 are attached to a coil bobbin 14 while being disposed at equal angles (symmetrically) about a central axis P of the coil bobbin 14 with respect to the coil bobbin 14, and the lead wires 17 and 17 and the connecting wire 20 are disposed in linear shapes.

For example, the connecting wire 20 is formed using the same material as that of the lead wire 17, and both ends of the connecting wire 20 are attached to a frame 2 and the coil bobbin 14, respectively. Similarly to the lead wire 17, the connecting wire 20 may have a function of supplying current to a voice coil 15.

<Third Modified Example>

In a third modified example, as illustrated in FIG. 35A, two lead wires 17 and 17 and one connecting wire 20 are attached to a coil bobbin 14 while being disposed at equal angles (symmetrically) about a central axis P of the coil bobbin 14 with respect to the coil bobbin 14, and the lead wires 17 and 17 and the connecting wire 20 are disposed in curved shapes.

For example, the connecting wire 20 is formed using the same material as that of the lead wire 17, and both ends of the connecting wire 20 are attached to a frame 2 and the coil bobbin 14, respectively. Similarly to the lead wire 17, the connecting wire 20 may have a function of supplying current to a voice coil 15.

<Fourth Modified Example>

In a fourth modified example, as illustrated in FIG. 35B, two lead wires 17 and 17 and two connecting wires 20 and 20 are attached to a coil bobbin 14 while being disposed at equal angles about a central axis P of the coil bobbin 14 with respect to the coil bobbin 14, and the lead wires 17 and 17 and the connecting wires 20 and 20 are disposed in linear shapes.

For example, the connecting wire 20 is formed using the same material as that of the lead wire 17, and both ends of the connecting wire 20 are attached to a frame 2 and the coil bobbin 14, respectively. Similarly to the lead wire 17, the connecting wire 20 may have a function of supplying current to a voice coil 15. In addition, three or more connecting wires 20 may be disposed when the connecting wires 20 and the lead wires 17 and 17 are symmetrically disposed about the central axis P of the coil bobbin 14 with respect to the coil bobbin 14.

<Fifth Modified Example>

Figure 36:
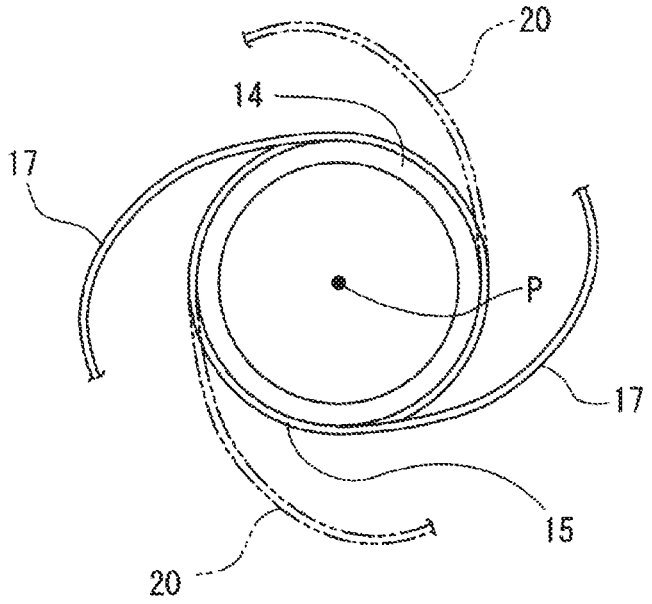
FIG. 36 is an enlarged front view illustrating a fifth modified example.

In a fifth modified example, as illustrated in FIG. 36, two lead wires 17 and 17 and two connecting wires 20 and 20 are attached to a coil bobbin 14 while being disposed at equal angles about a central axis P of the coil bobbin 14 with respect to the coil bobbin 14, and the lead wires 17 and 17 and the connecting wires 20 and 20 are disposed in curved shapes.

For example, the connecting wire 20 is formed using the same material as that of the lead wire 17, and both ends of the connecting wire 20 are attached to a frame 2 and the coil bobbin 14, respectively. Similarly to the lead wire 17, the connecting wire 20 may have a function of supplying current to a voice coil 15. In addition, three or more connecting wires 20 may be disposed when the connecting wires 20 and the lead wires 17 and 17 are symmetrically disposed about the central axis P of the coil bobbin 14 with respect to the coil bobbin 14.

As in the second modified example to the fifth modified example described above, when lead wires 17 and 17 and at least one connecting wire 20 are disposed at equal angles (symmetrically) about a central axis P of a coil bobbin 14, a rolling phenomenon of the coil bobbin 14 may be prevented from occurring, thereby attempting further improvement in sound quality of output audio.

SUMMARY

As described in the foregoing, in the speaker device 1, the sub-magnetic gap 21 and the main magnetic gap 13 are formed, and the sub-magnetic gap 21 is filled with the magnetic fluid 16 to hold the coil bobbin 14. In addition, the through-hole 14*a* is formed in the coil bobbin 14.

For this reason, the magnetic fluid 16 easily flows in the sub-magnetic gap 21, agitation thereof is suppressed, and centering effect that holds the coil bobbin 14 in a center position inside the sub-magnetic gap 21 is stable. Further, it is possible to attempt improvement in acoustic conversion efficiency and improvement in sound quality.

In addition, a magnetic gradient is formed to change a magnetic force with respect to the magnetic fluid 16 by changing a magnetic flux density in the circumferential direction of the center pole portion 11.

Therefore, when the coil bobbin 14 is changed, the magnetic fluid 16 is not scattered from the sub-magnetic gap 21, and the amount of the magnetic fluid 16 filling the sub-magnetic gap 21 is not reduced. In addition, the magnetic fluid 16 is not agitated, and thus it is possible to attempt improvement in acoustic conversion efficiency and improvement in sound quality.

In addition, a magnetic gradient that changes a magnetic force with respect to the magnetic fluid 16 by changing a magnetic flux density is formed in the axial direction of the center pole portion 11. Thus, it is possible to attempt further improvement in acoustic conversion efficiency and further improvement in sound quality.

Further, a minimum value Samin of a magnetic flux density in the circumferential direction is larger than a value corresponding to half a maximum value Tamax of the magnetic flux density in the axial direction. Thus, when the coil bobbin 14 is changed, the magnetic fluid 16 to be scattered is reliably held in the sub-magnetic gap 21 from the gaps 21*a*, 21*a*, . . . , and scattering of the magnetic fluid 16 may be reliably prevented.

In addition, a saturated magnetic flux of the magnetic fluid 16 is set to 30 mT to 40 mT, and a viscosity of the magnetic fluid 16 is set to 300 cp or less. Thus, scattering is prevented, and an output of excellent reproduced sound in the speaker device 1 may be ensured without change of the coil bobbin 14 being suppressed by the magnetic fluid 16.

When the magnetic flux change units 22*a*, 22*a*, . . . or the magnetic flux change units 11*x*, 11*x*, . . . , which form a magnetic gradient in the circumferential direction of the center pole portion 11, are formed on the inner circumferential surface of the sub-plates 22 and 22A or the outer circumferential surface of the center pole portions 11A and 11B, structures of the sub-plates 22 and 22A and the center pole portions 11A and 11B are not complicated, and it is possible to attempt improvement in acoustic conversion efficiency and improvement in sound quality after ensuring simplified structures.

In addition, when the magnetic flux change units 12, 12A, and 12B or the magnetic flux change units 12C, 12D, and 12E, which form magnetic gradients in the axial direction of the center pole portions 11, 11A, and 11B, are formed on the sub-plates 22, 22D, and 22E or in the center pole portions 11, 11A, and 11B, structures of the sub-plates 22, 22D, and 22E or the center pole portions 11, 11A, and 11B are not complicated, and it is possible to attempt improvement in acoustic conversion efficiency and improvement in sound quality after ensuring simplified structures.

Further, when the magnetic flux change units 12, 12A, 12B, 12C, 12D, and 12E are provided by causing distal end portions of the center pole portions 11, 11A, and 11B to protrude in the axial direction from the sub-plate 22 or disposing the front surface of the center pole portion 11 on rear sides of the front surfaces of the sub-plates 22, 22D, and 22E, the magnetic flux change units 12, 12A, 12B, 12C, 12D, and 12E may be easily provided.

Furthermore, since the support ring is attached to the inner circumferential portion of the sub-plate, stability of centering effect may be improved.

In addition, the main magnetic gap 13 is preferably positioned on a side of the vibration plate 18 from the sub-magnetic gap 21. In this case, the voice coil 15 is positioned on a side of the vibration plate 18. Thus, the sub-magnetic gap 21 may not be made large to prepare for assembly (insertion) of the coil bobbin 14, and improvement in magnetic flux density may be attempted.

Effects described in this specification are illustrative rather than restrictive, and another effect may be present.

The technology may employ the following configurations.

(1)

A speaker device including:

a magnet having a central axis;

a yoke having a central axis, the central axis of the yoke being identical to the central axis of the magnet, the magnet being attached to the yoke;

a main plate attached to the magnet;

at least one sub-plate attached to the magnet and positioned to be separated from the main plate in an axial direction of the central axis;

a coil bobbin formed in a tubular shape and changeable in the axial direction;

a voice coil wound around an outer circumferential surface of the coil bobbin, at least a portion of the voice coil being disposed in a main magnetic gap formed between the main plate and the yoke;

a vibration plate having an inner circumferential portion connected to the coil bobbin, and vibrating according to a change of the coil bobbin; and a magnetic fluid filling at least one sub-magnetic gap formed between the sub-plate and the yoke, wherein a through-hole positioned in the sub-magnetic gap filled with the magnetic fluid is formed in the coil bobbin.

(2)

The speaker device according to (1), wherein a magnetic gradient is formed to change a magnetic force with respect to the magnetic fluid by changing a magnetic flux density in the axial direction.

(3)

The speaker device according to (1) or (2), wherein a magnetic gradient is formed to change a magnetic force with respect to the magnetic fluid by changing a magnetic flux density in a circumferential direction of the central axis.

(4)

The speaker device according to any of (1) to (3), wherein the through-hole is formed at a position allowing a flow of the magnetic fluid between the sub-plate and the yoke in a variation range of the coil bobbin in the axial direction.

(5)

The speaker device according to any of (1) to (4), wherein a plurality of through-holes is formed to be separated from one another in a circumferential direction of the coil bobbin, and positions of the plurality of through-holes are shifted in the axial direction.

(6)

The speaker device according to any of (1) to (5), wherein the through-hole has a slit shape extending in the axial direction of the coil bobbin, and a plurality of through-holes is formed to be separated from one another in a circumferential direction of the coil bobbin, and positions of the plurality of through-holes are shifted in the axial direction.

(7)

The speaker device according to any of (1) to (6), wherein the main magnetic gap is positioned on a side of the vibration plate from the sub-magnetic gap.

(8)

The speaker device according to any of (1) to (7), wherein the sub-magnetic gap is positioned on a side of the vibration plate from the main magnetic gap, a support ring is attached to an inner circumferential portion of the sub-plate, and at least a portion of the support ring is positioned inside the inner circumferential surface of the sub-plate.

(9)

The speaker device according to (8), wherein the support ring corresponds to a magnetic substance.

(10)

The speaker device according to any of (1) to (9), wherein a saturated magnetic flux of the magnetic fluid is set to 30 mT to 40 mT, and a viscosity of the magnetic fluid is set to 300 cp or less.

(11)

The speaker device according to any of (3) to (10), wherein a magnetic flux change unit forming the magnetic gradient in the axial direction is provided in the sub-plate or the yoke.

(12)

The speaker device according to (11), wherein a distal end portion of the yoke is caused to protrude from the sub-plate in the axial direction, and the distal end portion is provided as the magnetic flux change unit.

(13)

The speaker device according to (11) or (12), wherein an inclined plane inclined in the axial direction is formed on a surface of the sub-plate or the yoke, and a portion on which the inclined plane is formed is provided as the magnetic flux change unit.

(14)

The speaker device according to any of (11) to (13), wherein a curved surface is formed on a surface of the sub-plate or the yoke, and a portion on which the curved surface is formed is provided as the magnetic flux change unit.

(15)

The speaker device according to any of (3) to (10), wherein a magnetic flux change unit forming the magnetic gradient in the axial direction is provided in the sub-plate and the yoke.

(16)

The speaker device according to (15), wherein an inclined plane inclined in the axial direction is formed on respective surfaces of the sub-plate and the yoke, and respective portions on which the inclined plane is formed are provided as the magnetic flux change unit.

(17)

The speaker device according to (15) or (16), wherein a curved surface is formed on a surface of the sub-plate or the yoke, and a portion on which the curved surface is formed is provided as the magnetic flux change unit.

(18)

The speaker device according to any of (1) to (17), wherein a plurality of lead wires connected to the voice coil is provided, and the plurality of lead wires is symmetrically disposed about a central axis of the coil bobbin.

(19)

The speaker device according to any of (1) to (18), wherein a plurality of lead wires connected to the voice coil, and at least one connecting wire connected to the coil bobbin are provided, and the plurality of lead wires and the connecting wire are symmetrically disposed about the central axis.

REFERENCE SIGNS LIST

1 Speaker device
7 Main plate
8 Magnet
9 Yoke
11 Center pole portion
11*x* Magnetic flux change unit
12 Magnetic flux change unit
13 Main magnetic gap
14 Coil bobbin
14*a* Through-hole
15 Voice coil
16 Magnetic fluid
17 Lead wire
11A Center pole portion
11B Center pole portion
12A Magnetic flux change unit
12*a* Inclined plane
12B Magnetic flux change unit
12*b* Curved surface
12C Magnetic flux change unit
12D Magnetic flux change unit
12*d* Inclined plane
12E Magnetic flux change unit
12*e* Curved surface
20 Connecting wire
21 Sub-magnetic gap
21*a* Gap
22 Sub-plate
22*a* Magnetic flux change unit
22A Sub-plate
25 Support ring

What is claimed is:

1. A speaker device comprising:

a magnet having a central axis;

a yoke having a central axis, the central axis of the yoke being identical to the central axis of the magnet, the magnet being attached to the yoke;

a main plate attached to the magnet;

at least one sub-plate attached to the magnet and positioned to be separated from the main plate in an axial direction of the central axis;

a coil bobbin formed in a tubular shape and changeable in the axial direction;

a voice coil wound around an outer circumferential surface of the coil bobbin, at least a portion of the voice coil being disposed in a main magnetic gap formed between the main plate and the yoke;

a vibration plate having an inner circumferential portion connected to the coil bobbin, and vibrating according to a change of the coil bobbin; and a magnetic fluid filling at least one sub-magnetic gap formed between the sub-plate and the yoke, wherein, the coil bobbin includes pluralities of through-holes positioned in the sub-magnetic gap and filled with the magnetic fluid, at least one of the through-holes is located at a position where the magnetic fluid is present, the sub-magnetic gap is positioned on a same side of the vibration plate as the main magnetic gap, a support ring is attached to an inner circumferential portion of the sub-plate, at least a portion of the support ring is positioned inside the inner circumferential surface of the sub-plate, a first one of the pluralities of through-holes is separated from a second one of the pluralities of through-holes in a circumferential direction of the coil bobbin, and positions of through-holes included in the first one of the pluralities of through-holes are shifted in the axial direction relative to positions of through-holes included in the second one of the pluralities of through-holes.

2. The speaker device according to claim 1, wherein the support ring corresponds to a magnetic substance.

3. The speaker device according to claim 1, wherein a magnetic gradient is formed to change a magnetic force with respect to the magnetic fluid by changing a magnetic flux density in the axial direction.

4. The speaker device according to claim 1, wherein a magnetic gradient is formed to change a magnetic force with respect to the magnetic fluid by changing a magnetic flux density in a circumferential direction of the central axis.

5. The speaker device according to claim 4, wherein a magnetic flux change unit forming the magnetic gradient in the axial direction is provided in the sub-plate or the yoke.

6. The speaker device according to claim 5, wherein a distal end portion of the yoke is caused to protrude from the sub-plate in the axial direction, and the distal end portion is provided as the magnetic flux change unit.

7. The speaker device according to claim 5, wherein an inclined plane inclined in the axial direction is formed on a surface of the sub-plate or the yoke, and a portion on which the inclined plane is formed is provided as the magnetic flux change unit.

8. The speaker device according to claim 5, wherein a curved surface is formed on a surface of the sub-plate or the yoke, and a portion on which the curved surface is formed is provided as the magnetic flux change unit.

9. The speaker device according to claim 4, wherein a magnetic flux change unit forming the magnetic gradient in the axial direction is provided in the sub-plate and the yoke.

10. The speaker device according to claim 9, wherein an inclined plane inclined in the axial direction is formed on respective surfaces of the sub-plate and the yoke, and respective portions on which the inclined plane is formed are provided as the magnetic flux change unit.

11. The speaker device according to claim 9, wherein a curved surface is formed on a surface of the sub-plate or the yoke, and a portion on which the curved surface is formed is provided as the magnetic flux change unit.

12. The speaker device according to claim 1, wherein the support ring extends into the sub-magnetic gap and contacts the magnetic fluid.

13. The speaker device according to claim 1, wherein the voice coil is spaced apart from the pluralities of through-holes in the axial direction.

14. A speaker device comprising:

a magnet having a central axis;

a yoke having a central axis, the central axis of the yoke being identical to the central axis of the magnet, the magnet being attached to the yoke;

a main plate attached to the magnet;

at least one sub-plate attached to the magnet and positioned to be separated from the main plate in an axial direction of the central axis;

a coil bobbin formed in a tubular shape and changeable in the axial direction;

a voice coil wound around an outer circumferential surface of the coil bobbin, at least a portion of the voice coil being disposed in a main magnetic gap formed between the main plate and the yoke;

a vibration plate having an inner circumferential portion connected to the coil bobbin, and vibrating according to a change of the coil bobbin; and a magnetic fluid filling at least one sub-magnetic gap formed between the sub-plate and the yoke, wherein, the coil bobbin includes pluralities of through-holes positioned in the sub-magnetic gap and filled with the magnetic fluid, the voice coil is spaced apart from the pluralities of through-holes in the axial direction, at least one of the through-holes is located at a position where the magnetic fluid is present, the sub-magnetic gap is positioned on a same side of the vibration plate as the main magnetic gap, a support ring is attached to an inner circumferential portion of the sub-plate, at least a portion of the support ring is positioned inside the inner circumferential surface of the sub-plate, the through-holes have a slit shape extending in the axial direction of the coil bobbin, and a first of the pluralities of through-holes is formed to be separated from a second of the pluralities of through-holes in a circumferential direction of the coil bobbin, and positions of the first and second pluralities of through-holes are shifted in the axial direction.

* * * * *